US006003893A

United States Patent [19]

Hansen

[11] Patent Number: 6,003,893

[45] Date of Patent: Dec. 21, 1999

[54] SNOWBOARD BINDING

[75] Inventor: Reinhard Hansen, Salzburg, Austria

[73] Assignee: Goodwell International Ltd., Tortila, Virgin Islands (Br.)

[21] Appl. No.: 08/992,762

[22] Filed: Dec. 17, 1997

[30] Foreign Application Priority Data

Dec. 19, 1996 [DE] Germany ..... 196 53 162

[51] Int. Cl.[6] ..... A63C 9/10

[52] U.S. Cl. ..... 280/624; 280/14.2; 280/616; 280/619; 280/621; 280/622; 280/634

[58] Field of Search ..... 280/14.2, 616, 280/619, 621, 622, 624, 634

[56] References Cited

U.S. PATENT DOCUMENTS

| | | | |
|---|---|---|---|
| 4,585,250 | 4/1986 | Nowak et al. | 280/618 |
| 4,979,760 | 12/1990 | Derrah | 280/607 |
| 5,265,901 | 11/1993 | Gorza | 280/632 |
| 5,556,123 | 9/1996 | Fournier | 280/607 |
| 5,690,352 | 11/1997 | Freisinger et al. | 280/632 |
| 5,692,765 | 12/1997 | Laughlin | 280/619 |
| 5,695,210 | 12/1997 | Goss et al. | 280/624 |
| 5,697,631 | 12/1997 | Ratzek et al. | 280/613 |
| 5,826,891 | 10/1998 | Albrecht | 280/14.2 |

FOREIGN PATENT DOCUMENTS

| | | | |
|---|---|---|---|
| 0 672 438A1 | 2/1994 | European Pat. Off. | A63C 9/08 |
| 37 17 108C2 | 5/1987 | Germany | A63C 9/084 |
| 44 06 047A1 | 2/1994 | Germany | A63C 9/08 |
| 44 16 024C1 | 5/1994 | Germany | A63C 9/00 |
| 44 16 023C1 | 6/1994 | Germany | A63C 9/00 |
| 44 35 113C1 | 9/1994 | Germany | A63C 9/00 |
| 94 21 380U1 | 10/1994 | Germany | A63C 9/086 |
| 44 24 737C1 | 1/1996 | Germany | A63C 9/00 |
| 295 20 277U1 | 6/1996 | Germany | A63C 9/00 |
| WO 95/09035 | 4/1995 | WIPO | A63C 9/086 |
| WO 95/20423 | 8/1995 | WIPO | A63C 9/10 |
| WO 95/33534 | 12/1995 | WIPO | A63C 9/08 |
| WO 96/01575 | 1/1996 | WIPO | A43B 5/04 |
| WO 96/03185 | 2/1996 | WIPO | A63C 9/08 |
| WO 96/05894 | 2/1996 | WIPO | A63C 9/02 |
| WO 96/26774 | 9/1996 | WIPO | A63C 9/08 |

*Primary Examiner*—Christopher P. Ellis
*Assistant Examiner*—James S. McClellan
*Attorney, Agent, or Firm*—Senniger, Powers, Leavitt & Roedel

[57] ABSTRACT

The snowboard binding with a pivoting heel element and a movable instep element has, in the area stepped on by the sole of the snowboard boot, a movable tread element that is coupled both to the instep element and to the heel element such that, when the tread element is pressed down in the direction of the snowboard surface, the instep element and the heel element are simultaneously and synchronously forcibly moved into their closed position.

25 Claims, 19 Drawing Sheets

78
h1
13
14
77
76
15
73
72
5
22
3
16

78
h2
h1
13
14
75
15
73
72
74
5
22
3
16

SNOWBOARD BINDING

BACKGROUND OF THE INVENTION

The invention pertains to a snowboard binding having a base element and a pivotable heel element. Snowboard bindings of this general nature have been disclosed, for example, in DE 44 16 023 C1. This binding has a heel or calf element that remains unchanged in the normal snowboarding position and an instep element connected so as to pivot via a lever rod to lateral cheeks of the binding, with this lever rod being directly coupled to the tread element and with a tread element pivoting about an axis perpendicular to the longitudinal axis of the binding being provided on this lever rod and pivoting the instep element downwards when stepped upon and being held in place in the closed position by a locking unit.

A similar snowboard binding is described in DE 295 20 277 U1, in which a continuous instep element extending past the boot tip is used, which instep element is fastened to an L-shaped lever that can pivot about an axis running across the longitudinal axis of the binding. The snowboarder steps into the free space formed by the L-shaped lever and the instep element with his boot tip and, by pressing the foot down, pivots the instep element into the closed position.

WO 95/33534 describes a snowboard binding without a step-in function, in which the heel element can be pivoted backwardly into an open position and is additionally coupled to the back end of the instep element such that, upon pivoting the heel element upwardly into a closed position, the instep element is pivoted in the opposite direction downwardly, likewise into a closed position.

U.S. Pat. No. 5,556,123 shows a snowboard binding without the step-in function, in which the instep element is crossed over by sheathed cables guided via idle rolls seated in the lateral cheeks to the back side of the pivoting heel element. If the heel element is moved forwardly from an open position in which it is pivoted backwardly and roughly horizontal into a vertical closed position, the instep element is pressed against the instep of the boot.

DE 44 35 113 C1 likewise shows a snowboard binding whose heel element can be pivoted sufficiently far into an open position that a snowboard boot can be inserted into the binding with a fixed instep element. An actuation unit consists of a belt reaching around the outside of the heel element and capable of being displaced along the outside of the heel element in the direction of the latter's free end and pivoting the heel element when displaced into a predefined closed position, in which the heel element supports the snowboard boot and presses it against the instep element, holding it there. To open and close this binding, the snowboarder must operate the belt by hand, for which purpose he must bend down.

To improve the comfort of snowboard bindings, a number of so-called "step-in bindings" have already been proposed, which are ultimately brought from an open into a closed position by moving the boot. Essentially, three types of step-in bindings are known. The first type works with so-called hard-shell boots whose soles have projections at the front and the back in which clamp clips of tensioning elements engage. Examples of this are found in EP 0 672 438 A1, DE 44 06 047 A1, WO 95/20423, and DE 44 24 737 C1. These bindings fit all common hard-shell boots, but not popular soft boots, as they are called, which are normally used with shell bindings that have a heel element supporting the heel and an instep element.

The second type of step-in binding places one binding component into the boot, in particular, the boot sole, and a second part, to be connected detachably to the first, on the snowboard. Examples of this are shown in DE 37 17 108 C2, DE 94 21 380 U1, WO 96/01575, WO 96/26774, WO 96/03185, WO 96/05894, or WO 95/09035. However, these bindings, some of which are quite comfortable to use, can only be used with special boots having the appropriate binding components. If these bindings are used with soft boots, then the boot must additionally take on the supporting function of the heel rest and the instep element, which causes additional problems because suitable boots are not yet on the market.

A third type of step-in binding, which can be used with nearly all boot types and in particular with soft boots, is known from the aforementioned DE 44 16 023 C1, DE 24 16 024 C1, and DE 295 20 277 U1.

In DE 44 16 023 C1, the binding has a heel or calf element that remains in the normal snowboarding position for getting in and out. There is also an instep element connected so as to pivot via a lever rod to lateral cheeks of the binding, with this lever rod being directly coupled to the tread element. A tread element pivoting about an axis perpendicular to the longitudinal axis of the binding is provided on this lever rod and pivots the instep element downwards when stepped upon, and is held in place in the closed position by a locking unit.

In DE 44 16 024 a rigid heel element is also used. The instep element is divided in two parts in the longitudinal direction of the binding with each part pivoting about an axis parallel to the longitudinal direction of the binding. Both instep element parts are rigidly connected to L-shaped levers likewise pivoting about this axis, with the boot sole pivoting the two instep element parts inward into a closed position upon stepping on the free legs of these levers. The snowboarder then, however, must close a tension belt connecting the two parts of the instep element.

DE 295 20 277 U1 uses a continuous instep element that extends past the boot tip and is fastened to an L-shaped lever that can pivot about an axis running across the longitudinal axis of the binding. The snowboarder steps into the free space formed by the L-shaped lever and the instep element with his boot tip and, by pressing the foot down, then pivots the instep element into the closed position.

WO 95/33534 describes a snowboard binding without a step-in function, in which the heel element can be pivoted backwards into an open position and is additionally coupled to the back end of the instep element such that, upon pivoting the heel element upwards into a closed position, the tread element is pivoted in the opposite direction downwards, likewise into a closed position.

SUMMARY OF THE INVENTION

An object of the invention is to improve the initially mentioned snowboard binding such that it offers optional support with the greatest possible comfort when getting in and out of any type of boot. This object is achieved with the characteristics specified in claim 1. Advantageous configurations and refinements of the invention can be seen in the subordinate claims.

The basic idea of the invention consists of the fact that the snowboard binding has a movable tread element in the tread area of the sole of the boot. The tread element is coupled both to the instep element and the heel element. Upon pressing the tread element downwards, the instep element and the heel element are simultaneously moved into their closed position. The heel and instep elements here undergo essentially opposing and synchronous pivoting movements.

Means are also provided to hold the tread element in the closed position.

Since the instep and heel elements are moved together, each has to move a smaller distance from the open to the closed position in comparison to the prior art, in which only one of the elements is moved. Thus, the tread element can be dimensioned such that it has a relatively small travel and nonetheless transfers sufficient force to the instep and heel elements to hold the boot in place. The boot itself need not be adapted to the binding in any way. Instead, any arbitrary boot can be used, in particular, soft, comfortable boots, since all required support and retention functions are taken over by the binding.

In the embodiment above, the tread element is constructed as a knee lever composed of two levers connected via an articulation, of which one lever is seated so as to pivot in the lateral cheeks of the binding. The free end of the other lever can thus be linearly displaced in the longitudinal direction of the binding and can be coupled via tension elements to the heel element and/or the instep element. Preferably, the knee lever is arranged such that its central articulation assumes a position past dead center in the closed position, which holds the tread element in place in the closed position.

According to another variant of the invention, the tread element is formed by a single lever, one of whose ends is likewise fastened so as to pivot to lateral cheeks of the binding, with this lever also being connected via tension elements or other links to the instep and heel elements and thus likewise bringing these into the closed position when the lever is pressed down.

According to a third variant of the invention, the tread element is a rod running transverse to the longitudinal axis of the binding, the two ends of which are connected directly or via tension elements to the heel element and the instep element.

The coupling of the tread element to the heel element and/or the instep element is done according to a preferred embodiment of the invention by tension elements, such as steel cables connected to the tread element and, for the embodiment with the heel element lever, the end of the second lever that can be linearly displaced and guided via idle rolls to the heel element and/or the instep element. The tension element leading to the heel element wraps around the heel element on the outside and is connected to its upper area. The associated idle roll, on the contrary, is mounted in the area of the front of the foot, so that the tension element, together with the heel element and the lateral cheeks, forms a triangle of forces and thus transfers forces directed backwards, which occur when snowboarding on the back edge into the front area of the foot and thus the vicinity of the front edge of the snowboard, which makes it easier to set the snowboard "on edge" and makes it possible to construct the heel element of relatively flexible material. The limit stop for a backwards motion used on conventional snowboard bindings can thus be omitted. Since the tension elements can be adjusted in length by a simple means, the limit position, particularly the "vorlage," can be continuously adjusted.

In a preferred variant of the invention, the instep element is also coupled via a suitable tension element and possibly an idle roll to the tread element. In one embodiment of the invention, one tension element is arranged on either side of the tread element and fastened at the back end of the instep element. In another variant of the invention, two tension elements are provided on each side of the instep element, one of which is fastened at the back end of the instep element and the other at the front end, so that the instep element is not pivoted about an axis perpendicular to the longitudinal axis of the binding, but instead is drawn downward parallel to the longitudinal axis and possibly backwards with a smaller component.

In another configuration of the invention, the instep element and the heel element are directly coupled. For this purpose, the heel element is extended past its pivoting articulation with a lever coupled via an articulation to the back end of the instep element so as to pivot. In this case, only one tension element is required, with the tension element wrapping around the heel element being used in one variant and with the tension element being fastened in the vicinity of aforesaid coupling between the heel element and instep element or on the lever of the heel element.

In a refinement of the invention, the front end of the instep element is fastened at both sides via a lever to the lateral cheeks, with one end of this lever being articulated to the lateral cheek and the other end articulated to the instep element. In this way, the instep element can also be displaced in the longitudinal direction of the binding inside the pivoting range of this lever, which has the additional quality that, upon opening the binding, the front edge of the instep element is elevated somewhat and thereby better exposes the boot.

According to a refinement of the invention, the lateral cheeks of the binding have a U-shaped transverse profile, which is open towards the upper side of the snowboard and forms a cavity, in which at least part of the tension elements and their idle rolls can be housed.

According to a refinement of the invention, a cylinder that can rotate or rollers that reduce friction between the boot sole and the tread element are arranged on a tread element. According to another refinement of the invention, a depression is present in the boot sole in the area of the tread element, which has the effect that the boot is moved backwards in the direction of the heel element when pressed down.

When the knee lever principle is used for the tread element, it is provided, according to another refinement of the invention, such that the free end of the knee lever is moved in horizontal guides, specifically in slots, which ensures that this free end moves only linearly and does not pivot upwards.

The fixation of the tread element in the closed position is done with the knee lever joint essentially by the above-specified position past dead center. It may additionally be provided, however, that the two knee lever elements are connected by a spring that holds them in place both in the closed position and the open-position. In another variant, the joint of the knee lever can be fastened in a lock washer. Finally, according to a refinement of the invention, a locking unit that extends in a form fit over part of the tread element, and thus locks it in place, is provided.

For opening the binding, according to a refinement of the invention, a lever is provided running upwards essentially parallel to the back side of the heel element and is attached at the free end of the knee lever element, upon the downward pivoting of which the knee lever element is opened.

In another variant of the invention, a tension element such as a cable or a belt is attached to at least one side of the knee lever joint and is guided along the heel element into the upper part of the latter. The binding can also be opened by tension on this cable or belt. If the locking element holding the tread element in place in a form fit is used, this is opened, according to a refinement of the invention, by a tension element guided over an idle roll and likewise reaches into the upper area of the heel area.

According to a refinement of the invention, the lever connecting the front end of the instep element to the lateral cheeks is initially tightened by a spring, which pulls the instep element backwards in the open position of the binding.

The above-described variants and configurations of the invention can be combined in a great variety of ways.

Finally, it should be pointed out that the terms "front" and "back" refer to the longitudinal axis of the binding. Forward refers to the direction towards the toe of the boot; backward refers to the direction towards the heel of the boot. The term "down" refers to the direction towards the surface of the snowboard surface and the term "up" designates the direction from the snowboard surface towards the snowboarder.

BRIEF DESCRIPTION OF THE FIGURES

The invention is described below on the basis of several embodiments in conjunction with drawings. The figures show in.

DETAILED DESCRIPTION OF THE INVENTION

Figure 1A:
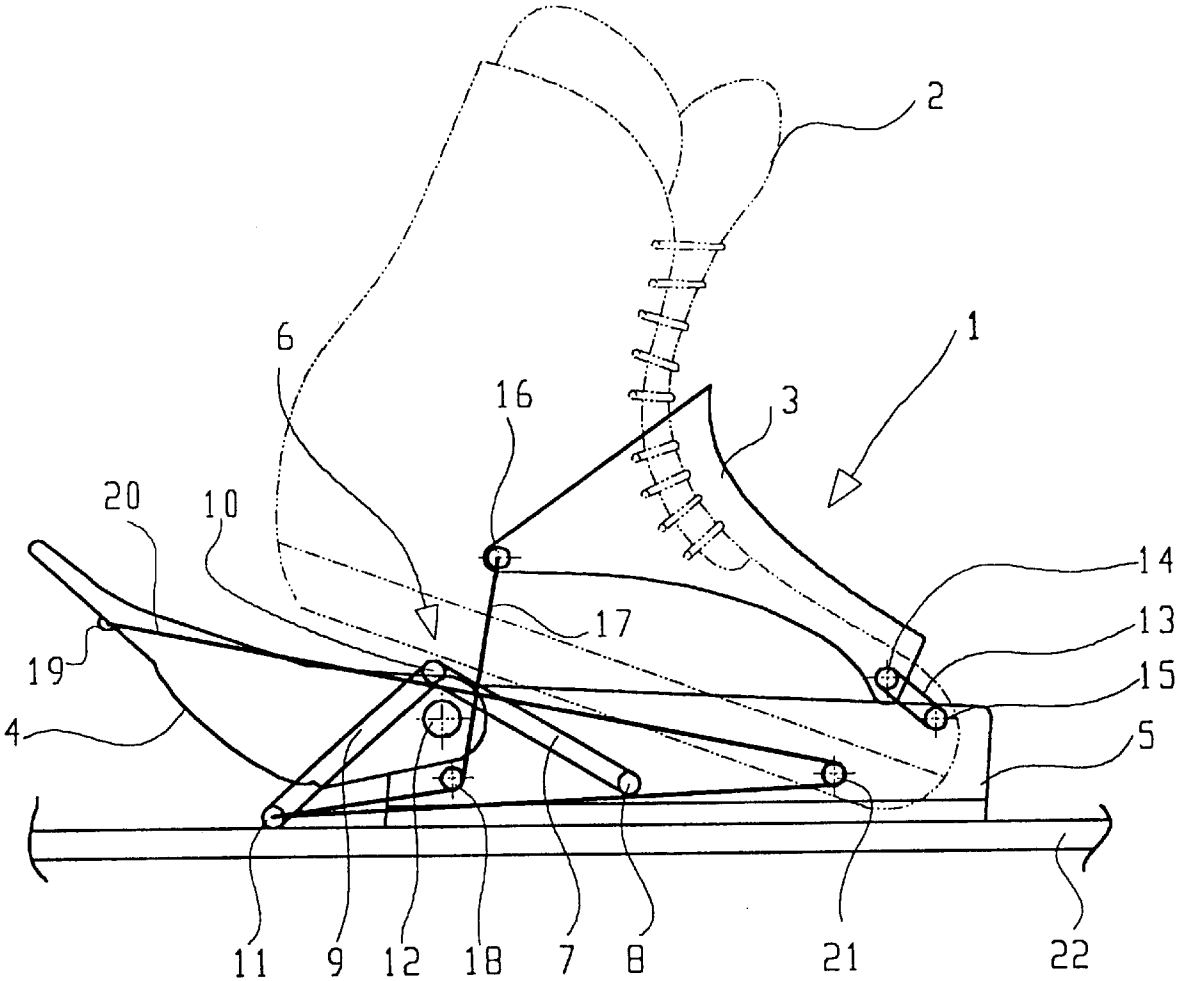
FIGS. 1A and 1B, a snowboard binding according to the invention with two tension elements in the open position (FIG. 1A) and the closed position (FIG. 1B)
Figure 1B:
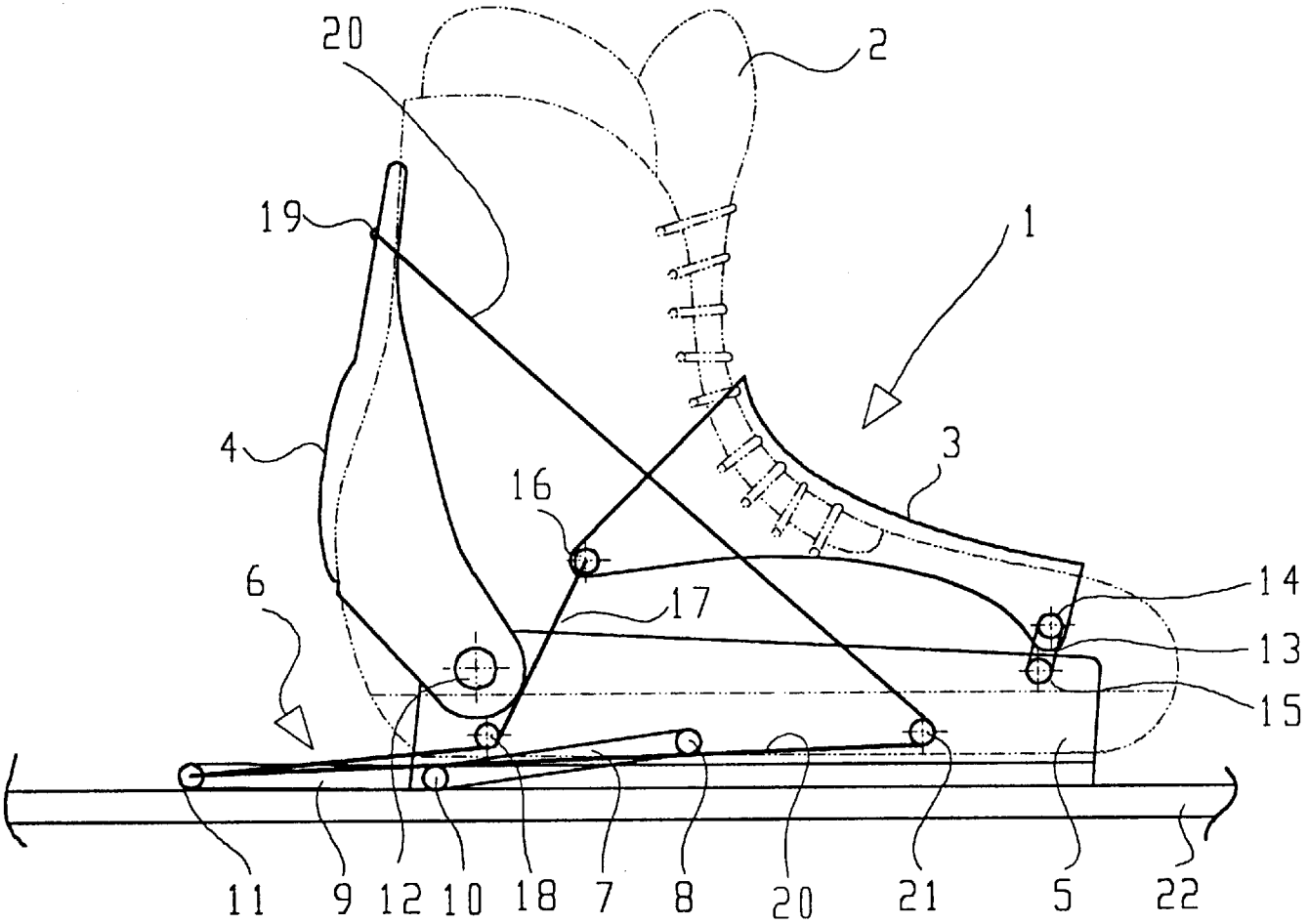

FIGS. 1A and 1B show an embodiment of the snowboard binding in the open (FIG. 1A) and the closed positions (FIG. 1B). The snowboard binding, identified in its entirety as 1, for fastening a snowboard boot 2 possesses an instep element 3 that essentially covers the front of the foot up to the instep, along with a heel element 4 that supports the back side of the boot, with these two elements 3 and 4 being seated so as to pivot on a base element or chassis. This base element consists of at least two lateral cheeks 5 attached to the snowboard 22, which cheeks each has a longitudinal axis arranged parallel to the longitudinal direction of the snowboard and the boot and essentially project vertically from the snowboard surface. As can be recognized from FIG. 6, these lateral cheeks are constructed in one piece with a base plate, which is retained by means of a rotating plate on the snowboard. The snowboard binding also has a tread element 6 coupled to the instep element 3 and the heel element 4 such that, upon pressing down the tread element 6, these two elements are pivoted from the open position of FIG. 1A into the closed position according to FIG. 1B.

In the embodiment of FIGS. 1A and 1B, the tread element is constructed as a knee lever consisting of a first lever 7 and a second lever 9, wherein the first lever 7 is attached at one end so as to pivot in a pivot bearing 8 on the lateral cheeks 5 and is connected at the other end so as to pivot to the second lever 9 by means of a joint 10, with the free end 11 of the second lever 9 being freely displaceable. This free end 11 of the second lever 9 can thus be displaced along the snowboard or parallel to its longitudinal axis, so that the spacing between the free end 11 and the pivot bearing 8 changes.

The heel element 4 is connected by means of a pivot bearing 12 to the lateral cheeks 5 and can be folded open to the rear, with reference to the longitudinal axis of the boot, to such an extent that the boot 2 can be obliquely introduced from above into the binding. The instep element 3 is also fastened so as to pivot to the lateral cheeks 5 in the front part, and can be pivoted forward.

The front end of the instep element is seated by means of a pivot lever 13 respectively connected at both ends via pivot bearings 14 and 15 to the instep element 3 or the respective lateral cheek 5, so that the instep element 3 can be not only pivoted but also displaced parallel to the snowboard surface and also to some extent perpendicular to the latter (see FIG. 1B). This double-jointed connection has the essential purpose of ensuring that the front upper edge of the instep element 3 does not move downwards during opening and thus jam the boot toe.

The back heel side of the instep element 3 has an eyelet 16 at either side, to which a tension element 17, a steel cable, for instance, is attached. This steel cable leads from the eyelet 16 to an idle roll 18, which is fastened to the lateral cheek 5, and from there to the free end 11 of the second lever 9. The idle roll 18 is located somewhat below the pivot bearing 12 and is situated such that the essential pulling direction of the tension element 17 is directed downwards to the snowboard surface but has a smaller rearward component of force, so that the tread element 3 is also pulled somewhat in the direction of the instep element.

In a similar manner, a tension element 20, which may also be a steel cable, is also fastened to the heel element 4. This tension element wraps around the outside of the heel element 4 and is protected against slipping on the latter in an eyelet 19. Instead of an eyelet 19, it is also possible to provide an adjustable loop via which one can adjust the height of the point of attack and thus the two limit positions of the heel element, particularly the "vorlage" in the closed position. The tension element 20 is likewise guided on both sides via idle rolls 21 mounted on the lateral cheeks 5, and from there to the free end 11 of the second lever 9 where it is fastened. The tension element 20 here can be a continuous cable that is guided from one side of the second lever 9, the second idle roll 21 around the back side of the heel element 4, and in the same manner on the other side.

To close the binding, which is in the open position drawn in FIG. 1A, the user introduces his boot at an angle from the top, essentially by swinging the knee joint, into the binding until the boot comes to a stop at the instep element 3. The boot toe is then already on the snowboard surface or the base plate. By lowering the heel, the sole of the boot 2 then touches the tread element 6, essentially the joint 10. This pivots the knee lever arrangement 7, 9 in the joints 8 and 10, and the free end 11 of the second lever is displaced backwards, whereby a tension is exerted on the tension elements 17 and 20. Thereby the back end of the instep element 3 is pulled downwards and simultaneously the heel element 4 is pivoted upwards until the binding is in the closed position illustrated in FIG. 1B, in which the boot 2 is held in place by the instep element 3 and the heel element 4, as well as the two lateral cheeks 5.

As is best recognized from FIG. 1B, the pivot bearing 8 is situated above the snowboard surface, while with a completely closed binding the joint 10 and the free end 11 of the second lever 9 are in contact with the snowboard surface or the base plate. The knee lever arrangement 7, 9 is thus situated in a point past dead center and is thus locked. Tensile forces that act via the tension elements 17 and/or 20 on the free end 11 of the second lever 9 thus have the result that the joint 10 is only pressed more tightly (downward) against the surface of the snowboard. Since, in a practical embodiment (see, in particular, FIGS. 5–7 and 8) the boot heel 9 lies on top of the second lever 9 and presses the latter downwards, the binding remains locked even under stresses of the tension elements acting in the opening direction.

The opening of the binding is done by moving the knee lever arrangement in the opposite direction, as is described further below in conjunction with FIG. 10. With the invention, one obtains an automatically closing binding that can be closed by the boot alone, without the snowboarder having to bend down to the binding. Forces directed backwards, which appear when the snowboarder places a load on the back edge of the snowboard, are introduced by the tension element 20 holding the heel element 4 in the closed position directly into the front of the binding 5 and thus into the front area of the snowboard, which is favorable for guiding the edge of the snowboard and for non-tiring snowboarding.

The effective length of the tension elements 17 and 20 is adjustable; with respect to the tension element 20, this is done, as described above, with a loop. The tension element 17 can also be displaced in another manner, for example, by a knurled screw, by an adjustable toothed belt of conventional construction, which is positioned between the eyelets 16 and the end of the tension element 17, or also by changing the attachment point of the tension element 17 at the free end 11 of the second lever 9.

Figure 2:
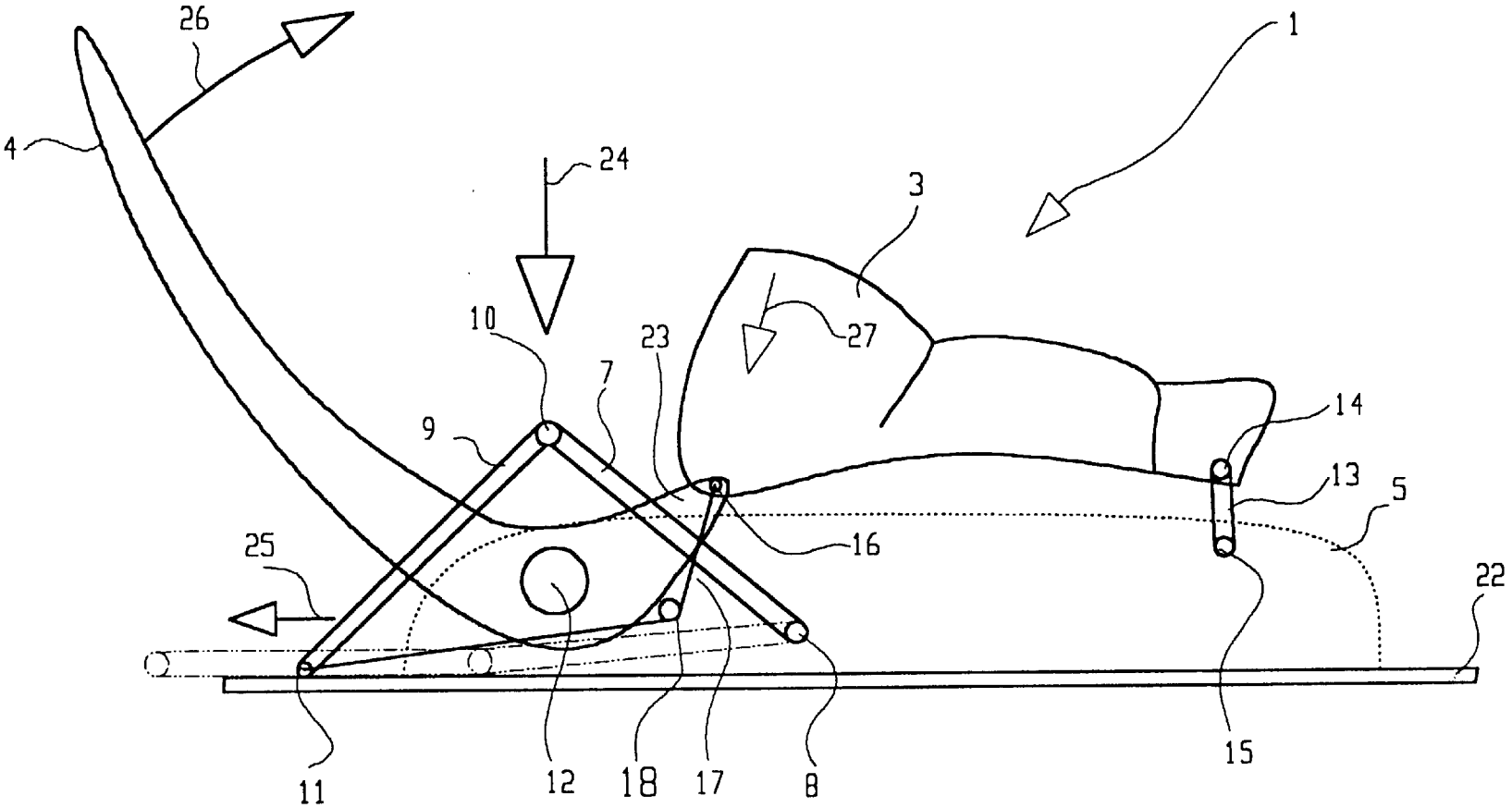
FIG. 2, a schematic side view of an embodiment with a tension element and direct coupling between the instep element and heel element.

FIG. 2 shows a variant of the invention, which also operates with a knee lever arrangement as the tread element but uses only one tension element 17 acting simultaneously on the instep element 3 and the heel element 4. For this purpose, the heel element 4 has a leg 23 extending forwardly beyond the pivot bearing 12 in the direction of the instep element 3 and is coupled so as to pivot to the instep element 3 such that the instep element 3 and the heel element 4 are pivoted in opposite directions. The heel element 4 is thus roughly L-shaped in its side view, with the pivot bearing 12 lying between the two legs 23 and the shorter leg lying between the pivot bearing 12 and the eyelet 16 of the instep element 3. The connection between the free end of the leg 23 and the instep element 6 is accomplished via a pivot bearing inserted into the eyelet 16. Also attached to this pivot bearing is the tension element 17. It would also be possible, however, to have the tension element somewhat further away, specifically either on the leg 23 or the instep element 3.

If a force is exerted in the direction of the arrow 24, the knee lever arrangement pivots such that the free end 11 of the lever 9 is moved in the direction of the arrow 25 and thus entrains the tension element 17. Thereby, the connection point between the lever 23 and the instep element 3 is pulled downwards in the direction of the arrow 27 and the heel element 4 is simultaneously pivoted forwards in the direction of the arrow 26, whereby the binding is closed. The front end of the instep element 3 can be moved forwards by the lever 13 with the two bearings 14 and 15 and simultaneously somewhat downwards, so that a sufficient retention force is exerted even in the front area.

Figure 3:
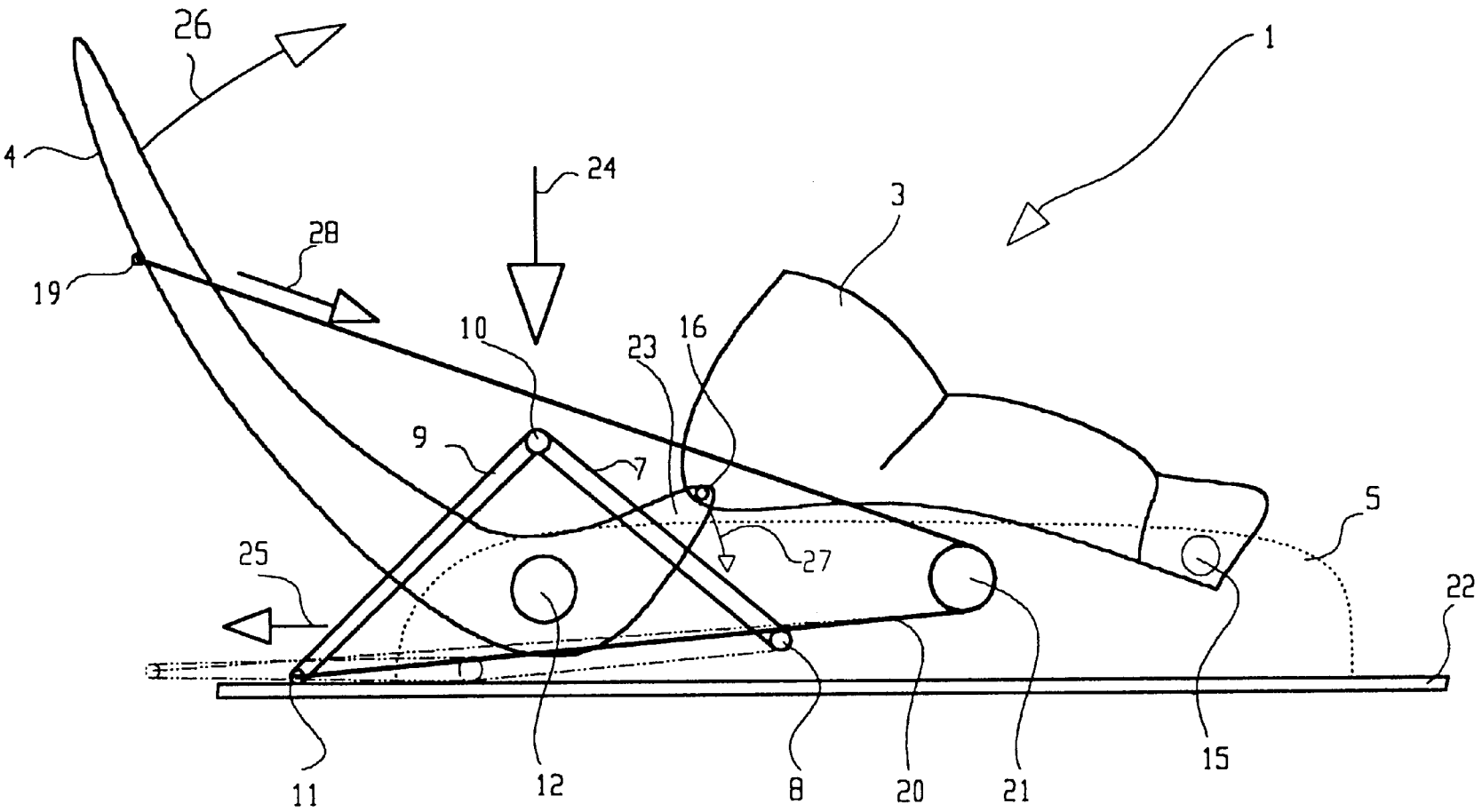
FIG. 3, a schematic side view of a snowboard binding likewise with only one tension element, which wraps around the heel element.

FIG. 3 shows another variant of the invention with only one tension element 20, which differs from FIG. 2 in that the tension element 20 acts on the outside of the heel element 4, while the articulation between the lever 23 and the instep element 3 is not connected to a tension element, but is moved only by the coupling of instep element 3 and heel element 4 in the area of the eyelet 16, and by the stiffness of the lever 23 and the heel element 4. It is also recognizable in FIG. 3 that the front end of the instep element 3 can also be connected directly via a pivot bearing 15 to the respective lateral cheek 5.

If the tread element here is pressed down in the direction of the arrow 24, the tension element exerts a force directed forwards/downwards in the direction of the arrow 28 on the upper area of the heel element 4, whereby the latter is pivoted forwards about the pivot bearing 12 in the direction of the arrow 26. The lever 23 simultaneously entrains the back end of the instep element 3 downwards in the direction of the arrow 27.

Figure 4:
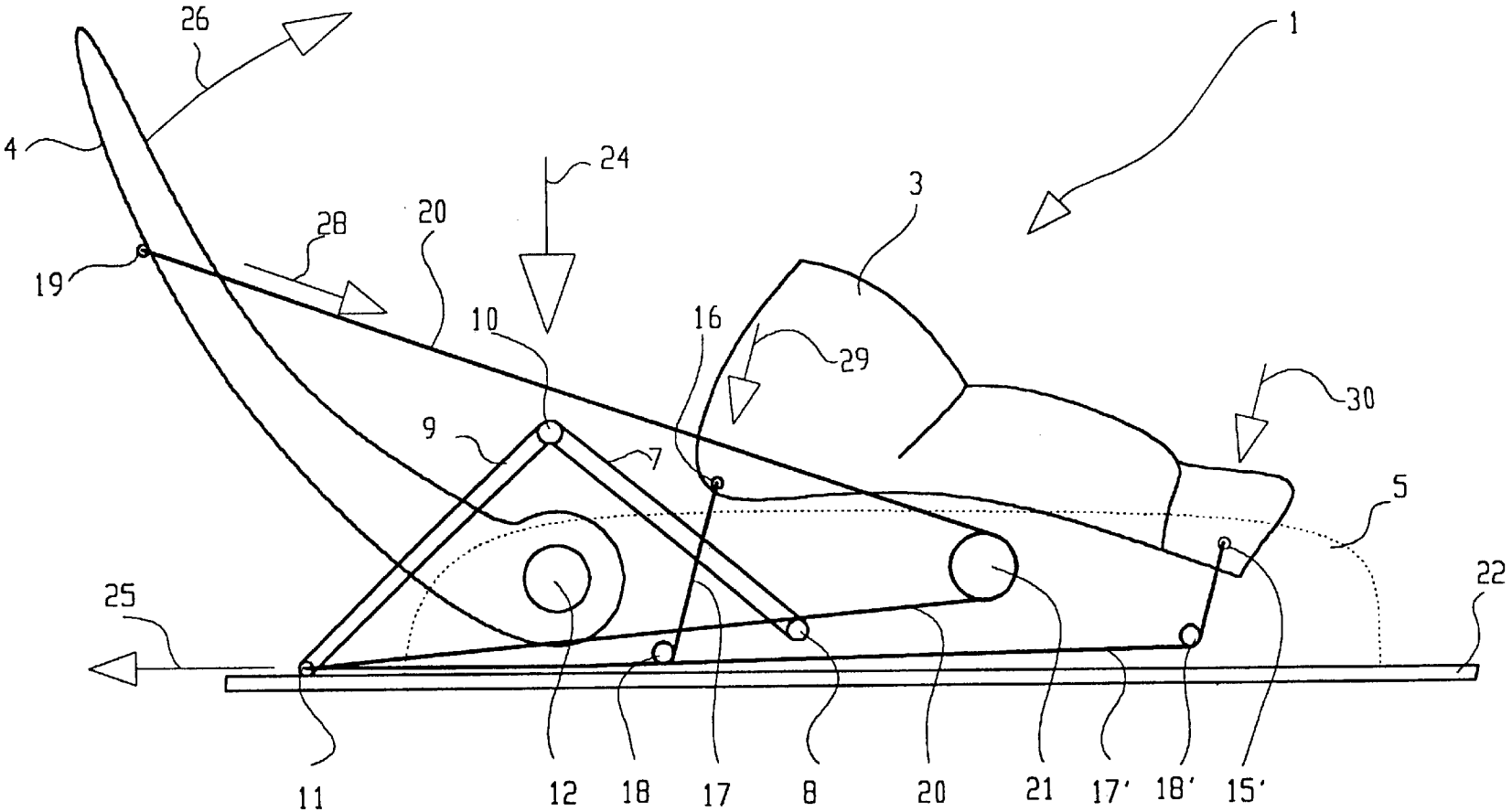
FIG. 4, a schematic side view of a snowboard binding according to a second embodiment of the invention with three tension elements.

FIG. 4 shows, in the same schematic representation as FIGS. 2 and 3, an embodiment with three tension elements 17, 17', and 20 all connected to the free end 11 of the lever 9. In comparison to FIG. 1, therefore, the third tension element 17' has been added. When the knee lever arrangement is pressed down, the tension element 17 pulls the lower end of the instep element 3 in the direction of the arrow 29 and simultaneously pulls the tension element 20 in the direction of arrow 28, whereby the heel element 4 is pivoted in the direction of the arrow 26. The third tension element 17' is additionally provided, fastened at the front end of the instep element 3 to an eyelet 15' and connected via an idle roll 18' to the free end 11 of the lever 9, so that the front end of the instep element 3 is also moved downwards in the direction of the arrow 30. The idle roll 18' here can be offset somewhat to the back with respect to the eyelet 15', so that the instep element 3 is also pulled somewhat backwards and is thus more strongly pressed against the instep of the foot.

Figure 5:
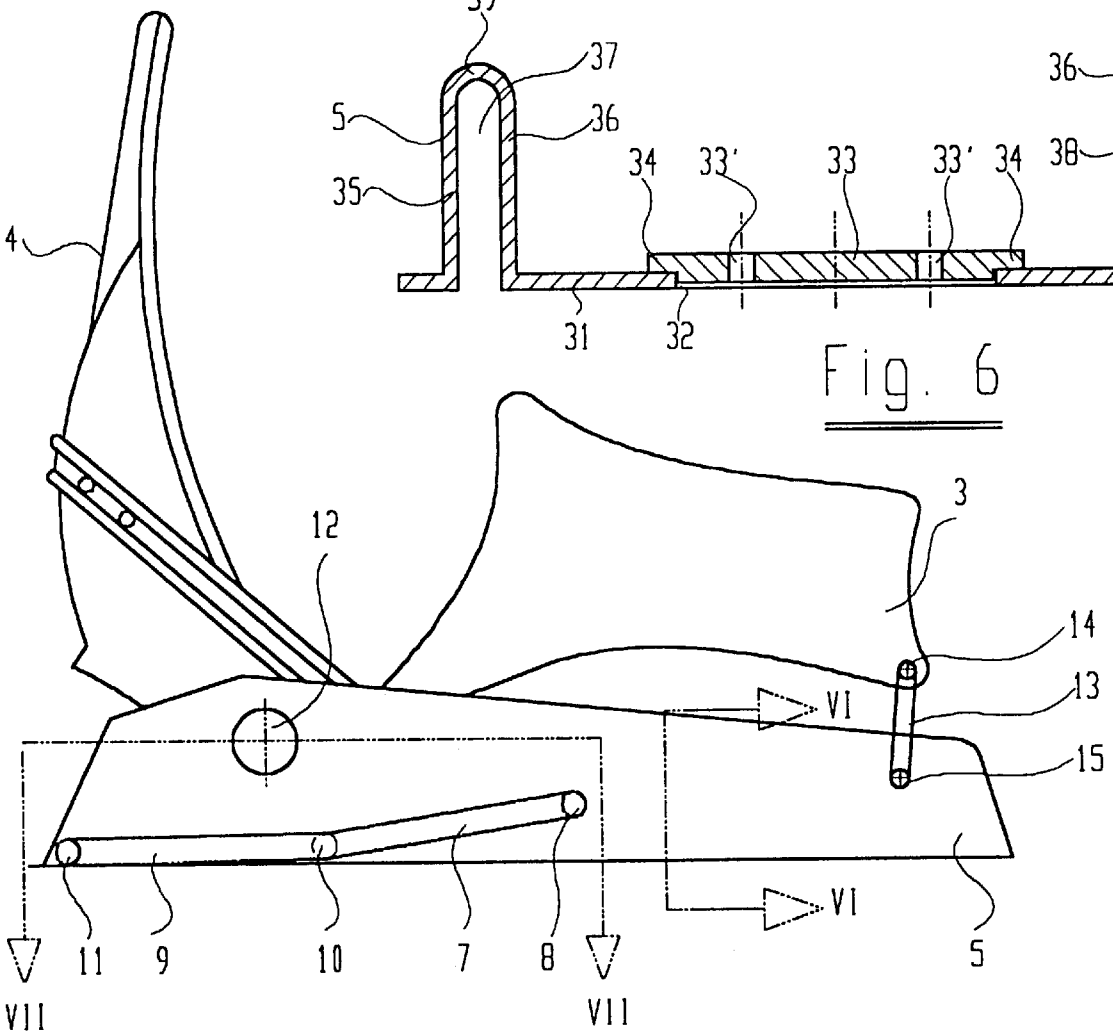
FIG. 5, a side view of a practical embodiment of a snowboard binding with a knee lever constructed as a tread element corresponding to the embodiments of FIGS. 1–4.

FIG. 5 shows a side view of the binding, which is suited in principle to all variants of FIGS. 1–4, where it must be pointed out that the knee lever arrangement 7–11 is arranged between the lateral cheeks 5 such that, in the closed position of the binding, the free end 11 of the lever 9 still lies inside the area covered by the heel element 4, and thus does not project backwards beyond the binding. This is of importance because the binding, mounted at an angle to the longitudinal axis of the snowboard on snowboards, which are becoming narrower and narrower, must not project beyond the edges of the snowboard.

Figure 6:
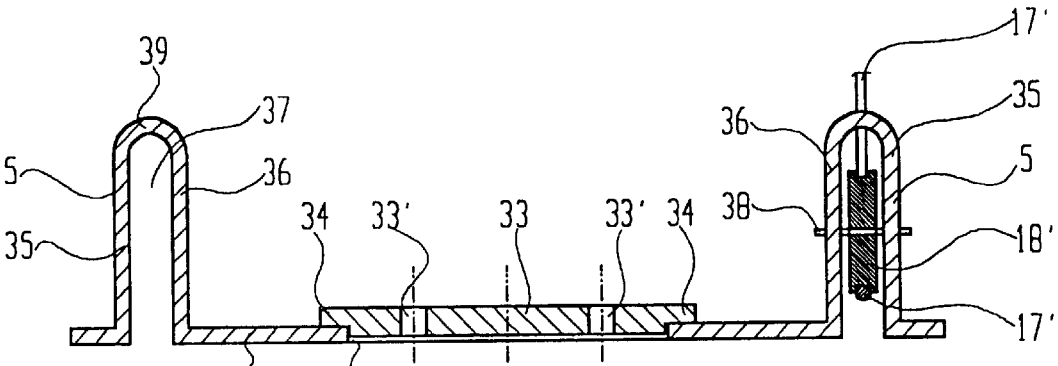
FIG. 6, a section along line VI—VI of FIG. 5, i.e., a cross section through the front part of the snowboard binding.

FIG. 6 shows a cross section along line VI—VI of FIG. 5 to illustrate the base plate with a revolving plate and the two lateral cheeks 5. As is conventional, the binding has a flat base plate 31 with a central circular opening 32, into which a revolving plate 33 is inserted and which covers the opening 32 with a radially projecting rim 34. The revolving plate 33 has several drilled holes 33' with which it is screwed to the snowboard and thus presses the base plate 31 against the snowboard surface. Vertical lateral cheeks 5 stick out at either side of the base plate 31 and here have a U-shape profile which as a whole increases the stiffness and creates a cavity 37 open downwards between parallel walls 35 and 36, in which space the idle rolls 18, 18', and 21 can be seated at either side and in which the tension elements are also guided. This is illustrated on the right side of FIG. 6 by the idle roll 18' and the tension element 17', with the idle roll 18' being seated by a pin 38 in the two walls 35 and 36. In the areas in which tension elements or other components must penetrate the intermediate space 37, a bent wall section 39 connecting the two walls 35 and 36 with an opening, not visible here, is provided.

Figure 7:
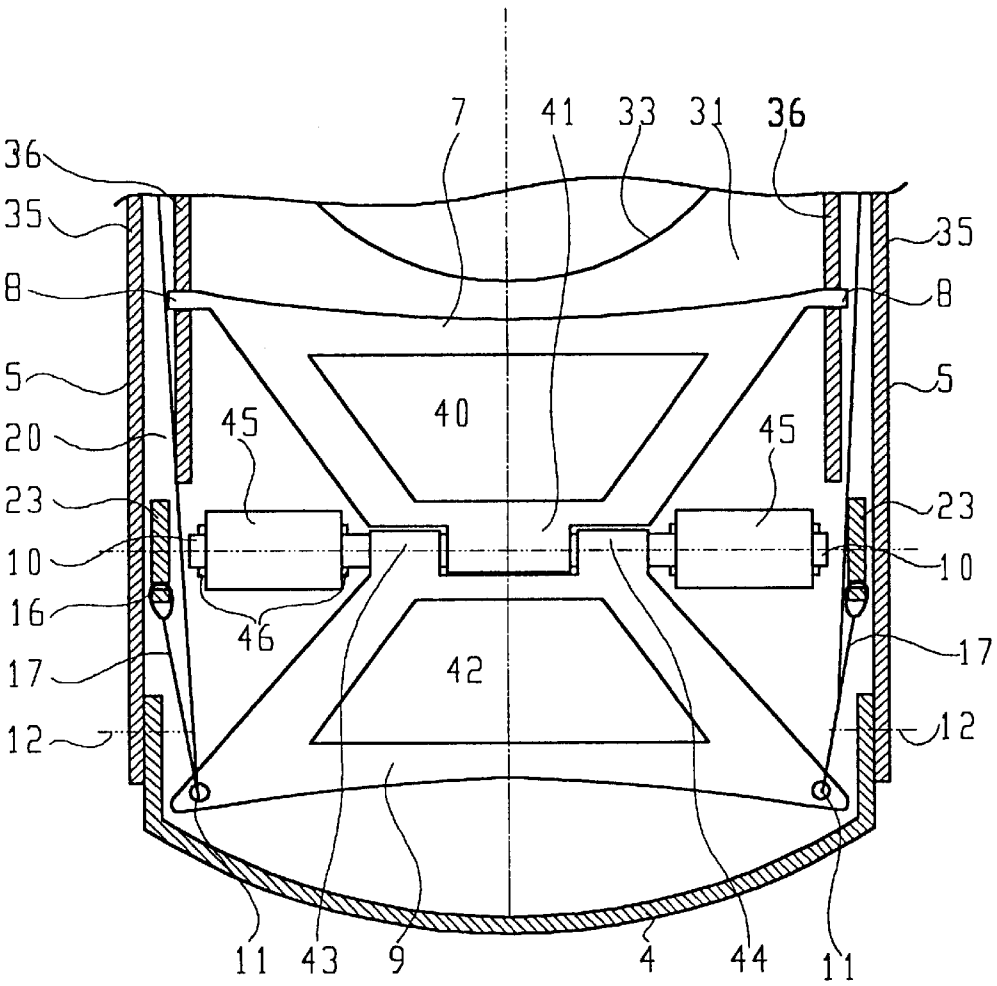
FIG. 7, a section along line VII—VII of FIG. 5, i.e., a plane view onto the back part of the binding with a tread element constructed as a knee lever.

FIG. 7 shows a section along line VII—VII of FIG. 5; this in principle shows a top view of the back part of the binding in order to illustrate the tread element. The first lever 7 has a trapezoidal shape when viewed from the top, having a central trapezoidal recess 40. One end of it has two projecting pins, one on either side, which form the pivot bearing 8 together with a drilled hole in the walls 36.

The pivot joint 10 is formed by a shaft in which the lever 7 is fastened by a central clip 41 surrounding the axis 10. In an analogous manner, the second lever 9 is also trapezoidal, having a central trapezoidal recess 42, with this lever being fastened by two clips 43 and 44 on shaft 10. The shaft 10 projects on either side past the clips 43 and 44 and supports cylindrical rolls 45 on either side, which are seated on it so as to rotate and project radially past the clips 41, 43 and 44, so that the boot comes into contact only with the rolls 45 in stepping onto the binding. These rolls 45 are protected against axial displacement by lock washers 46. At the rear, free end 11 of the lever 9, eyelets are mounted on either side, to which the corresponding tension elements 17 and possibly 17' and/or 20 are attached.

It is also evident from FIG. 7 that individual components, such as the tension element 20, are guided in the cavity 37 between the two walls 35 and 36 and are thus not visible from the outside. The pivot bearing 8 is also fastened only to the interior walls 36 and is thus likewise not visible from the outside. In the area in which the lever 23 penetrates into the cavity 37, the latter is open towards the top because, for example, the interior walls 36 are not extended completely in the longitudinal direction of the binding.

Figure 8:
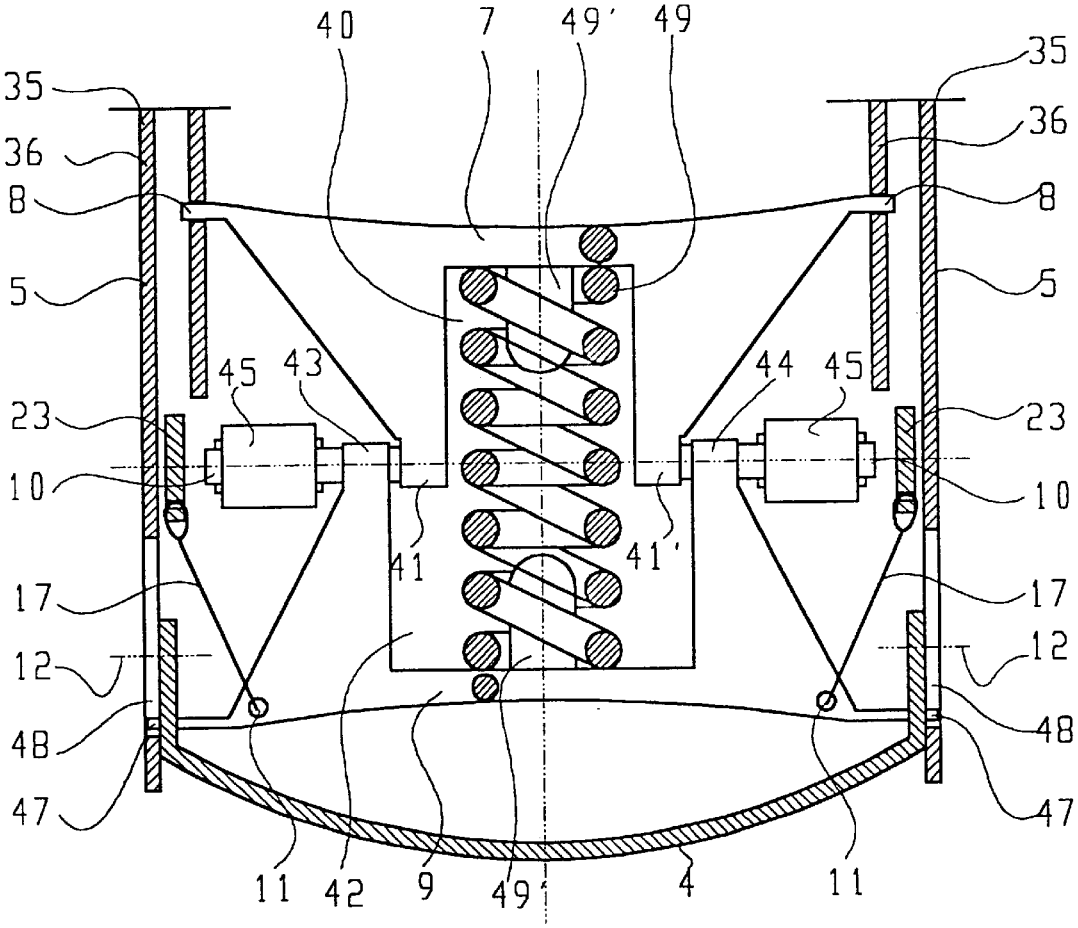
FIG. 8, a sectional view similar to FIG. 7, according to an additional variant of the invention, in which the knee lever element is prestressed by a spring and in which one lever arm of the knee lever element is compulsorily guided in a straight line.

FIG. 8 shows a sectional view similar to FIG. 7 according to an additional variant of the invention, which differs from FIG. 7 essentially in that the free end 11 of the lever has laterally projecting pins 47 guided so as to be longitudinally displaced in slots 48 of the side wall 35, which prevents the lever 9 from being able to fold open upwards in an uncontrolled manner. The embodiment of FIG. 8 also differs from that of FIG. 7 in that the two levers 7 and 9 have central open recesses 40 and 42, which have a throughspace for accommodating a spring 49, with the axis 10 being split in two parts in this case and thus not covering the space required by the spring 49. The spring 49 is attached to the two levers 7 and 9 and acts a tension spring so that the two ends of the levers 7 and 9, which have separated from the central shafts 10, are drawn together. Thus, the knee lever arrangement is pressed on the one hand into the open position, and on the other hand, the closed position is locked by the spring force in conjunction with the aforementioned past dead center position. If the second lever 9 is guided by the pins 47 in the slots 48, it is assured, even when the heel of the boot is relieved of force, that the binding will not open inadvertently, since the free end of the lever 9 cannot pivot upwards.

For better guidance of the spring 48, the two levers can also have brackets 49' projecting into the recess to prevent slippage of the spring.

Since the shaft 10 is split into two parts, the first lever 7 also has two clips 41 and 41', which are attached to the respective half-axis 10.

Figure 9:
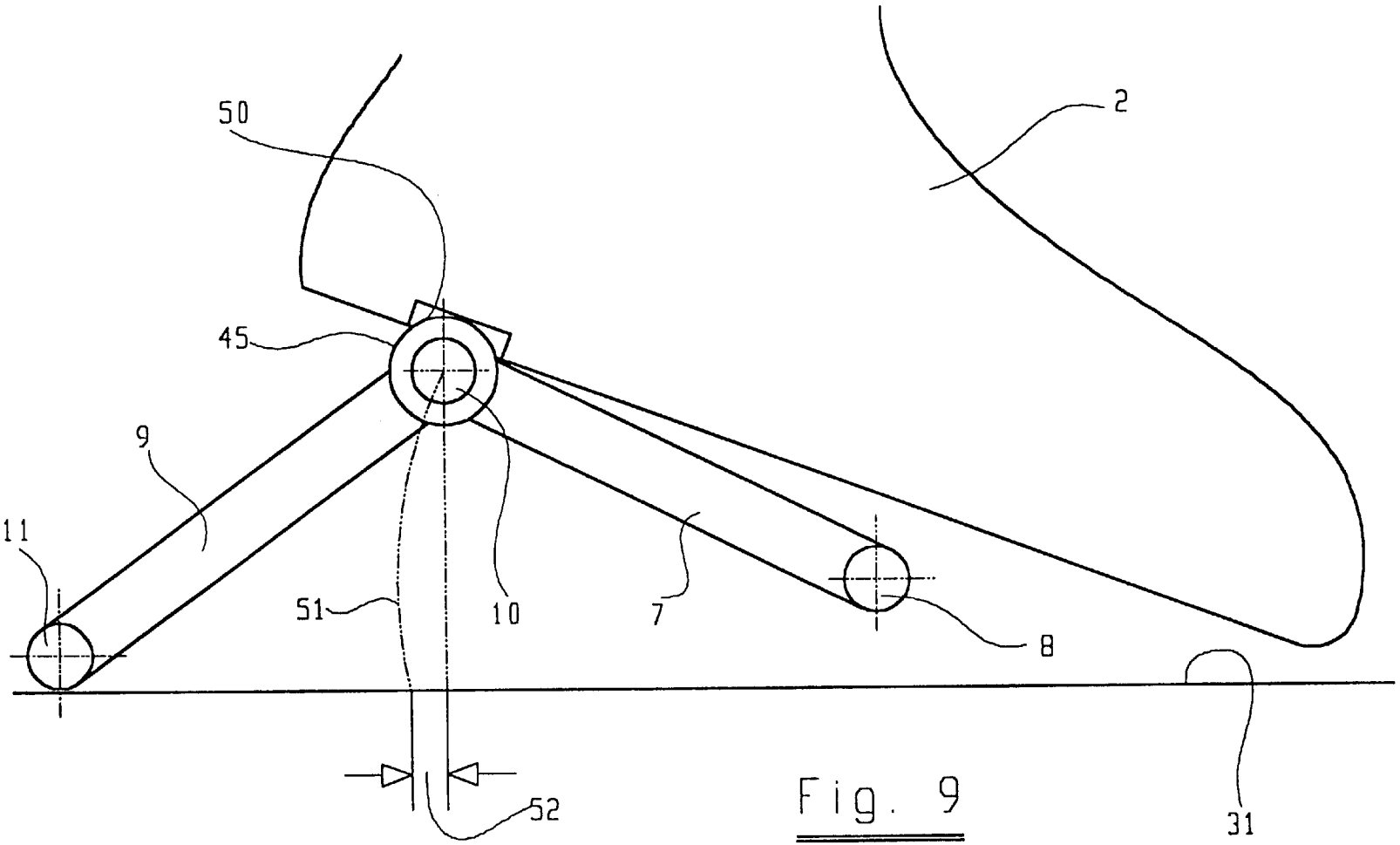
FIG. 9, a schematic side view of a tread element and boot according to a refinement of the invention.

FIG. 9 shows a schematic side view of a knee lever arrangement 7–11 and a boot 2. It is evident from this that, according to a refinement of the invention, a depression 50 is present in the boot sole, into which depression the shaft 10 or the rolls 45 engage and thereby guide the boot with respect to the knee lever arrangement. Since the shaft 10 pivots upon closure of the binding about the joint 8 along the circular arc 51, the boot is thereby also entrained for a certain distance 52 backwards and thus is pressed against the heel element, so that a better support of the boot on the heel element is achieved.

FIGS. 10A–D show different variations of the invention and clarify how, on the one hand, the knee lever arrangement is held in place in the closed position and how it can also be opened again, with these variants being applicable to all previously described embodiments of the invention.

Figure 10A:
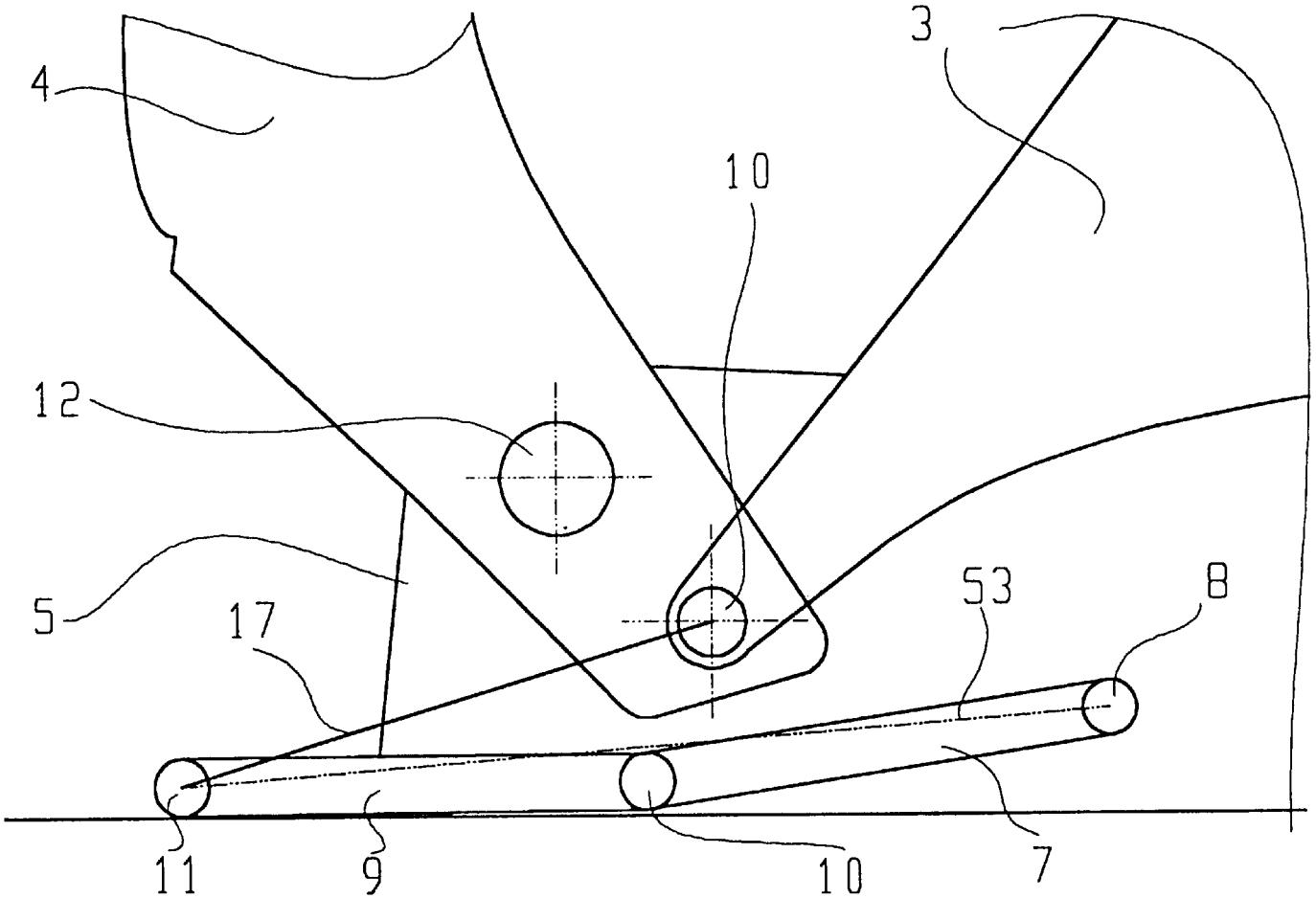
FIG. 10A, a partially broken side view of the binding, in order to clarify the past dead center position of the knee levers.

It is clarified in FIG. 10A that the two levers 7 and 9 have a past dead center position in the closed position. The dead center position, in which the two levers lie in a straight line, is illustrated here by the dashed line 53. If, for instance, a force is exerted via the tension element 17 onto the free end 11 of the lever 9, a force component oriented vertically downwards and pressing the binding even more into the closed position acts on the joint 10.

Figure 10B:
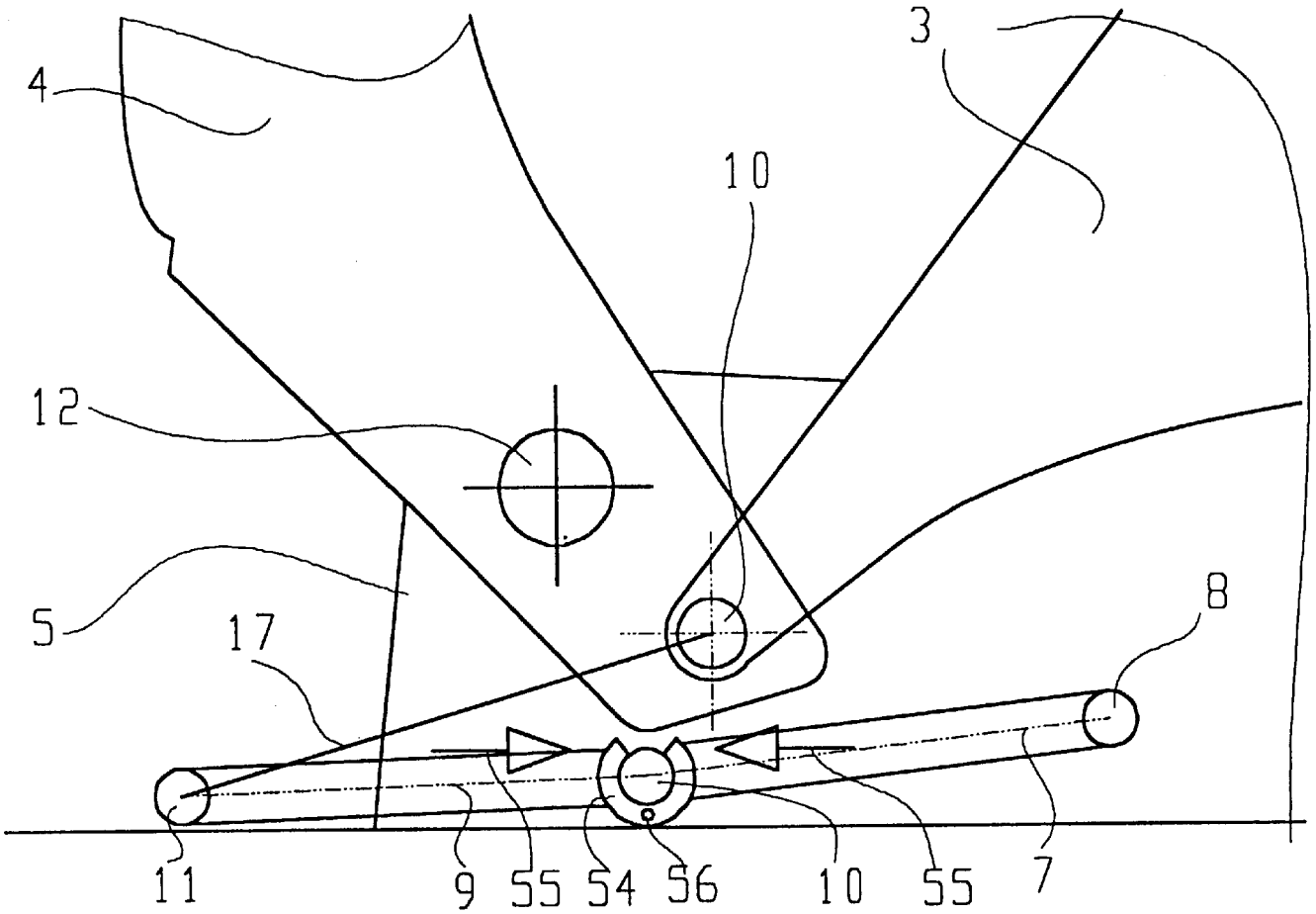
FIG. 10B, a side view similar to FIG. 10A, with a lock washer as a means of fixation for the tread element.

In FIG. 10B, the closed position is maintained by a lock washer 54 engaging with the shaft 10. This lock washer is split so as to be open to the top and can thus open upon introduction of the shaft 10. If the shaft 10 has been introduced, the lock washer 54 presses in the direction of the arrows 55 against the shaft 10 and holds it in place. The lock washer is attached, riveted, welded, or connected by a threaded fastening to the side walls 5, as indicated by a drillhole 56 in the lock washer 54.

Moreover, in FIG. 10B as well, the two levers 7 and 9 are arranged such that a position past dead center is assumed in the closed position, which additionally protects the closed position.

Figure 10C:
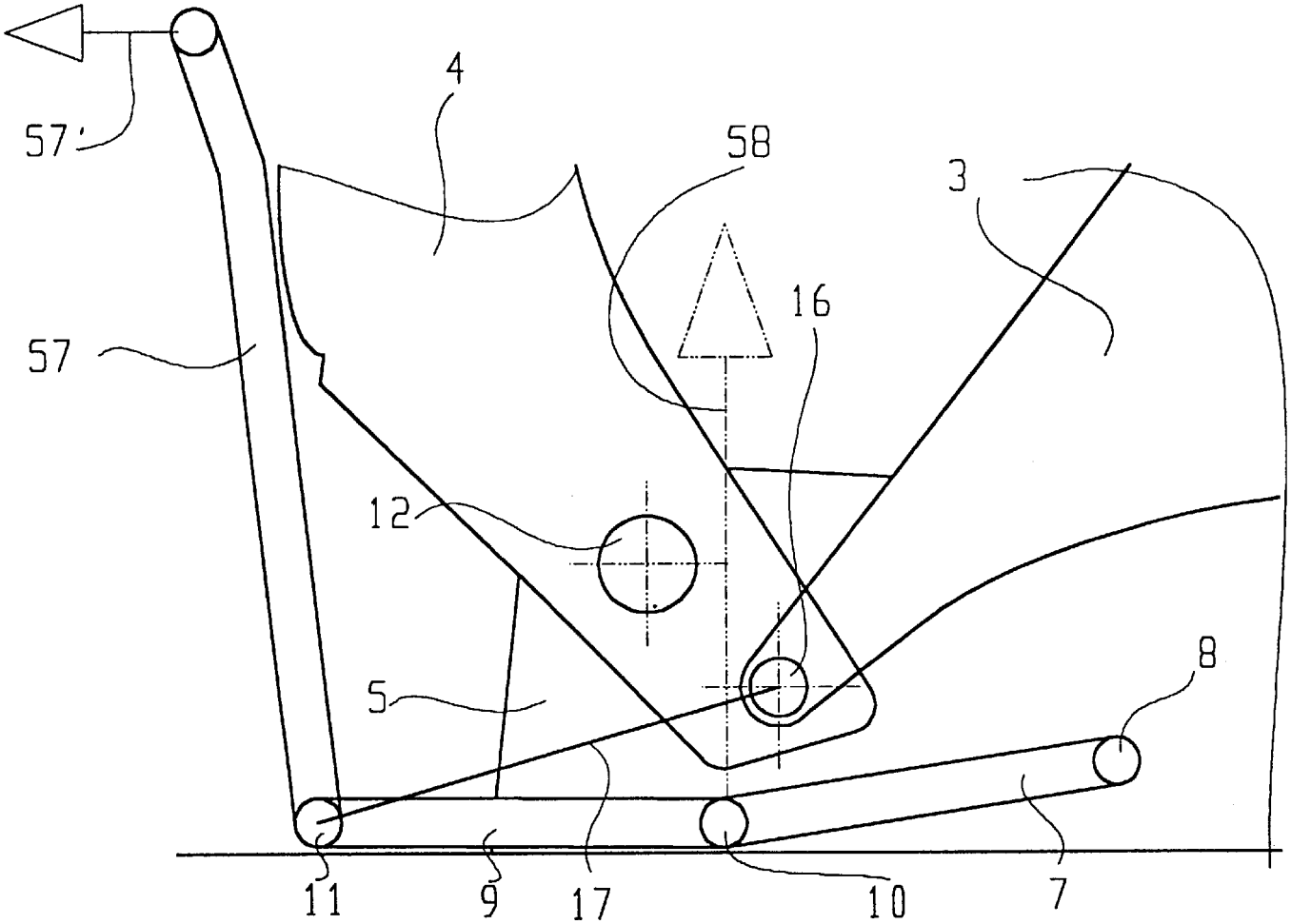
FIG. 10C, a similar partially broken side view with a pivoting opening lever.

In FIG. 10C, an opening lever 57 is provided, rigidly connected to the free end 11 of the second lever 9, and is situated on the outside of the heel element 4. If this opening lever 57 is pivoted in the direction of the arrow 57' a force oriented upwards in the direction of the arrow 58, which brings the knee lever arrangement into the open position, acts via the rigid connection to the second lever 9.

Figure 10D:
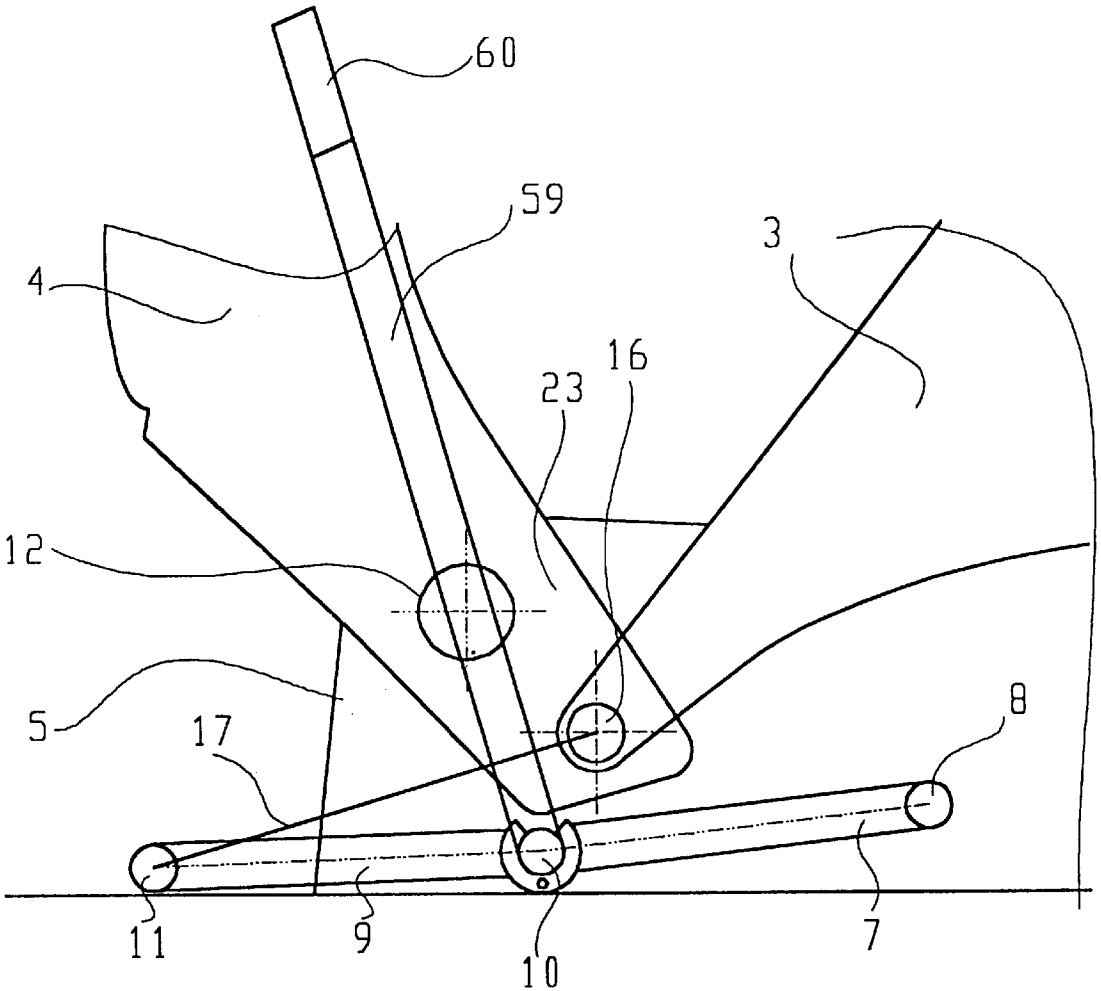
FIG. 10D, a side view similar to FIG. 10B, with a tension element for opening the binding.

In the variant of FIG. 10D, a tension element 59, which is guided on the side of the heel element 4 into the area of the latter's upper end and terminates there in a loop 60, is fastened to the joint 10 of the knee lever arrangement. If the user pulls on this tension element 59, the joint 10 is likewise pulled upwards and the binding moves into the open position. The tension element 59 here is preferably a flat belt. Both opening variants of FIGS. 10C and 10D can be freely combined with the closing variants of FIGS. 10A and 10B.

Figure 11:
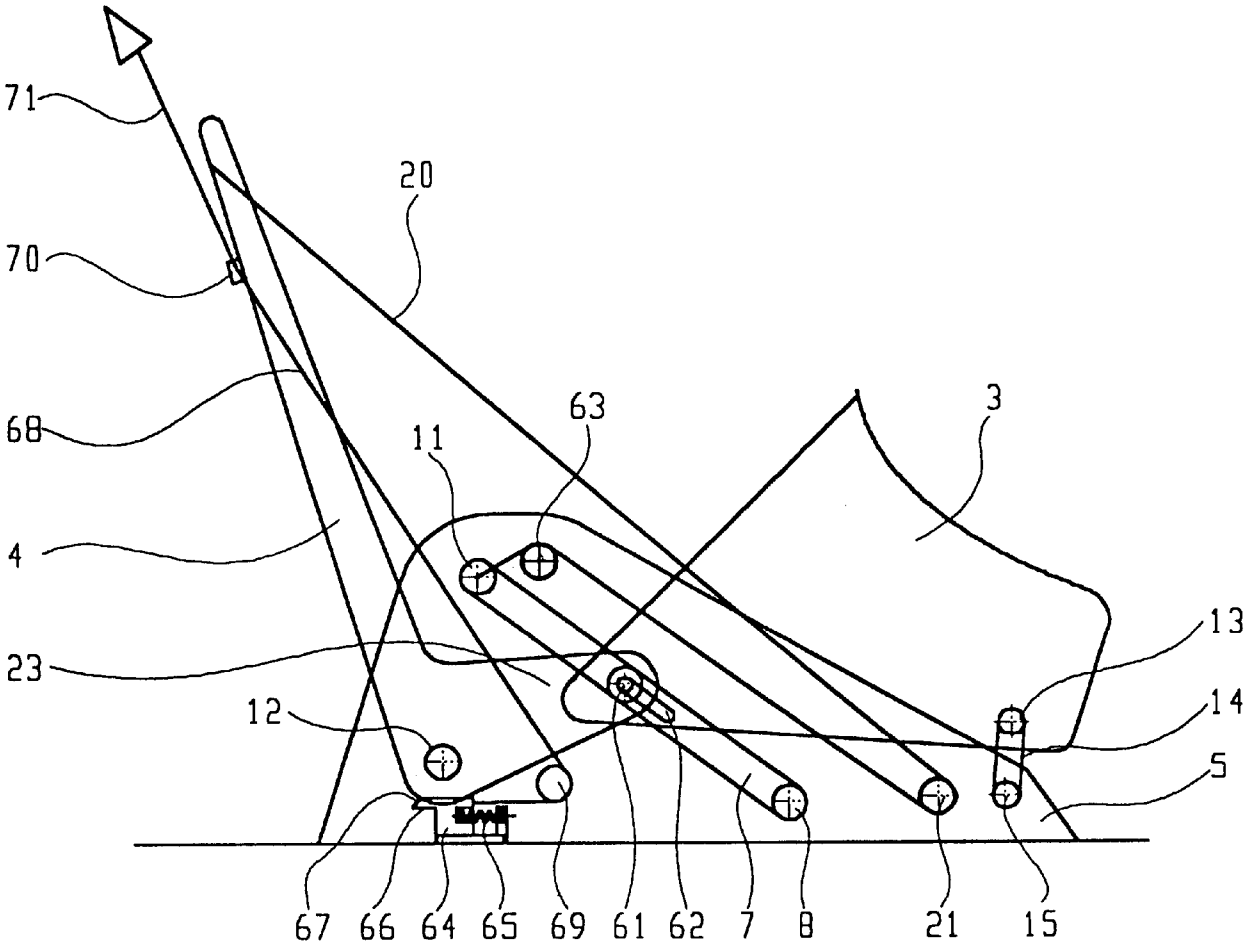
FIG. 11, a schematic side view of a snowboard binding according to an additional variant of the invention, with a tread element constructed as a one-piece lever and a tension element wrapping around the heel element.

FIG. 11 shows an additional variant of the invention, in which only one single continuous lever attached to the lateral cheeks 5 so as to pivot by means of a pivot bearing 8 is used as a tread element instead of a knee lever 7 arrangement. In this variant, as also seen in FIGS. 2 and 3, the instep element 3 and the heel element 4 are directly coupled. A pin 61 used for coupling is guided here in a slot 62 of the lever 7, with this slot lying here roughly in the middle of the longitudinal axis of the lever 7. At the free end 11 of the lever 7, a tension element is again fastened, with the tension element 20 acting on the upper back end of the heel element 4 in the embodiment illustrated here. Since the spacing between the pivot bearing 8 and the idle roll 21 is relatively small for the tension element 20, and thus since only a small length change of the free end 11 of lever 7 with respect to the idle roll 21 can be achieved in a pivoting of the lever about the pivot bearing 8, an additional idle roll 63 is provided, over which the tension element 20 is guided on the way from the idle roll 21 to the free end 11 of the lever 7. The displacement path of the tension element 20 when the tread element is stepped on is therefore determined by the arrangement of the idle roll 63, specifically the relative position of the idle roll 21 and the pivot bearing 8.

In the illustrated configuration, the idle roll 63 is relatively close to the free end 11 of the lever 7 in the open position of the latter, so that a maximum displacement path is obtained for the tension element 20.

If the free end 11 of the lever 7 is pressed downwards, on the one hand, a tensile force is exerted on the tension element 20 and, on the other hand, the lever 23 and the back end of the instep element 3 are also pressed downwards via the pin 61. To lock the binding, an independent locking arrangement 64 is provided here, which is pushed into a closed position by a spring 65 and which has a locking tab 66 that positively retains the free end 11 of the lever 7. This end can, for instance, be constructed as a pin or a cylindrical rod, as is implemented in FIG. 8 by the pins 47. The locking tab 66 has an incline 67 such that the locking element is pressed forwards against the force of a spring 65 upon pressing the lever down, and subsequently, when the free end 11 has slid past the tab 66, again is pressed backwards by the spring 65, whereby the tab 66 positively locks the lever. To open the binding, another tension element 68 is provided, which acts on the locking element 64 and is guided over an idle roll 69 and in an eyelet 70 in the upper area of the heel element 4 and is connected there, if desired, to a loop, a handle or the like. If the tension element is pulled in the direction of the arrow 71, the locking element 64 is displaced against the force of the spring 65 and uncovers the lever 7, so that the binding can be opened.

Although not shown in FIG. 11, the variant with only one lever 7 can also be used with another configuration of tension elements, as illustrated in FIGS. 1–4. If the various tension elements that act either on the heel element, the back and/or the front end of the instep element should have a differently long displacement path, this can be achieved in that the ends of the tension elements act on different points of the longitudinal extent of the lever 7.

Figure 12A:
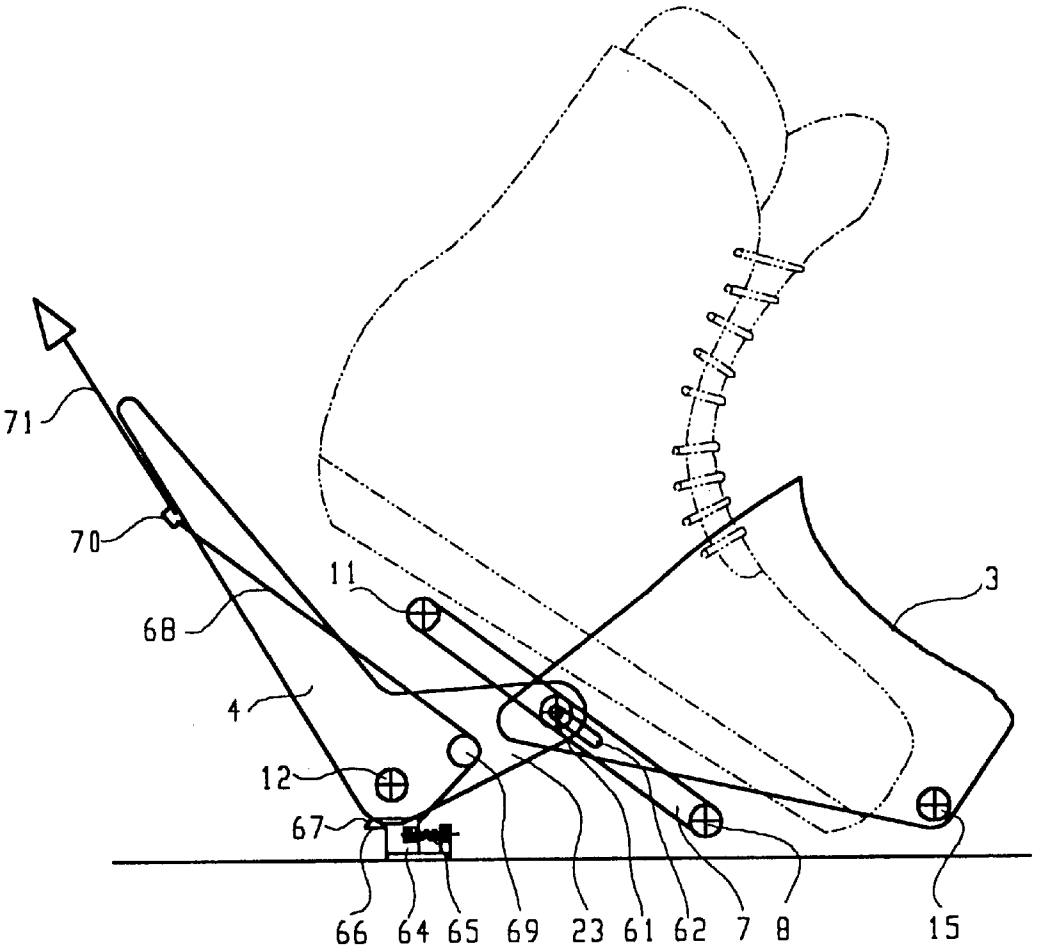
FIGS. 12A and 12B, a side view in the open position (FIG. 12A) and the closed position (FIG. 12B) according to another variant of the embodiment of FIG. 11, with direct coupling between the instep element and heel element without the use of tension elements.
Figure 12B:
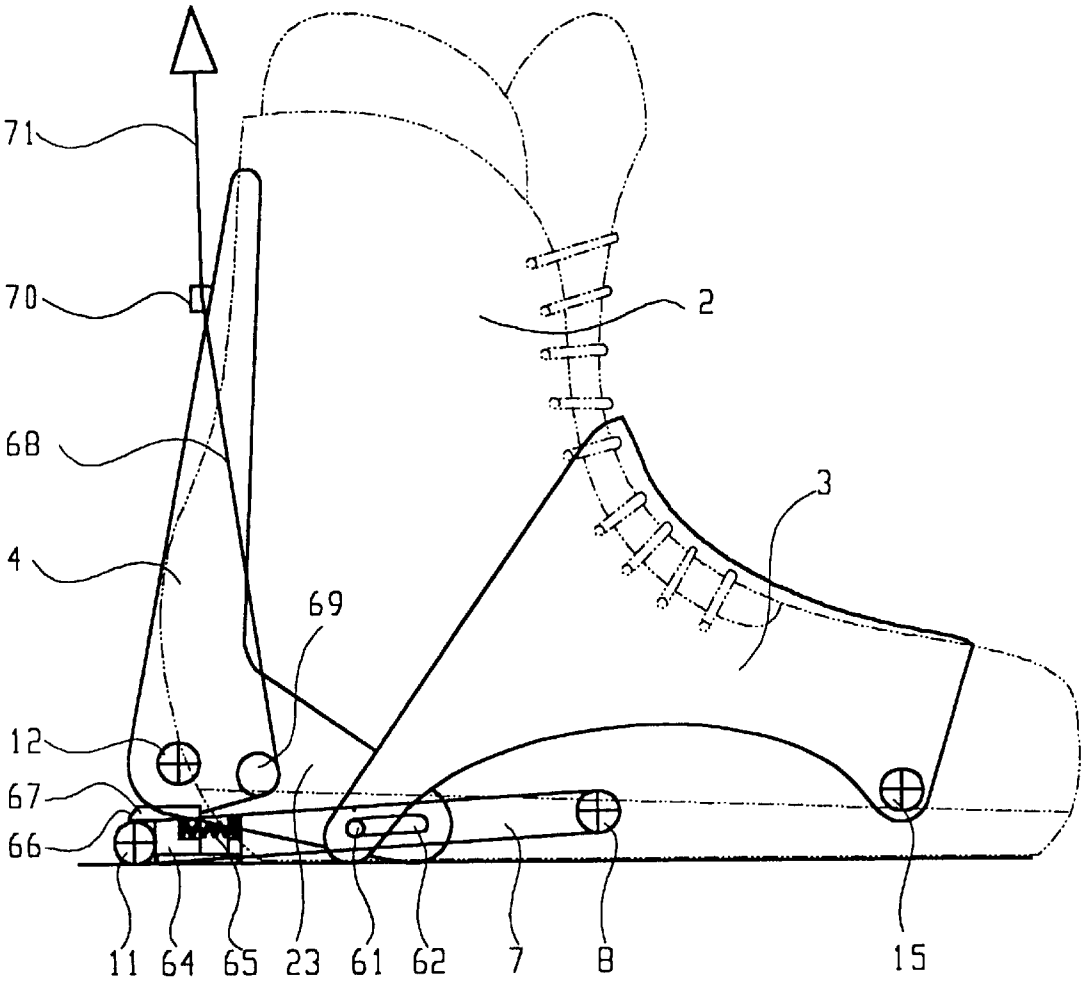

FIGS. 12A and 12B show a variation of FIG. 11, which likewise operates with a continuous lever 7 but completely without tension elements for closing the binding. The instep element 3 and the heel element 4 are directly coupled by the pin 61 guided in the slot 62 of the lever 7. Upon pressing down the free end 11 of the lever 7, the latter is pivoted about the pivot bearing 8, whereupon the pin 61 presses the instep and heel elements downwards and brings the binding into the closed position (FIG. 12B), in which the free end 11 of the lever 7 is held in the locking unit 64. Otherwise, this embodiment agrees with that of FIG. 11, wherein the lateral cheeks 5 in FIGS. 12A and 12B have been omitted for a more easily understandable presentation.

Figures 13A, 13B:
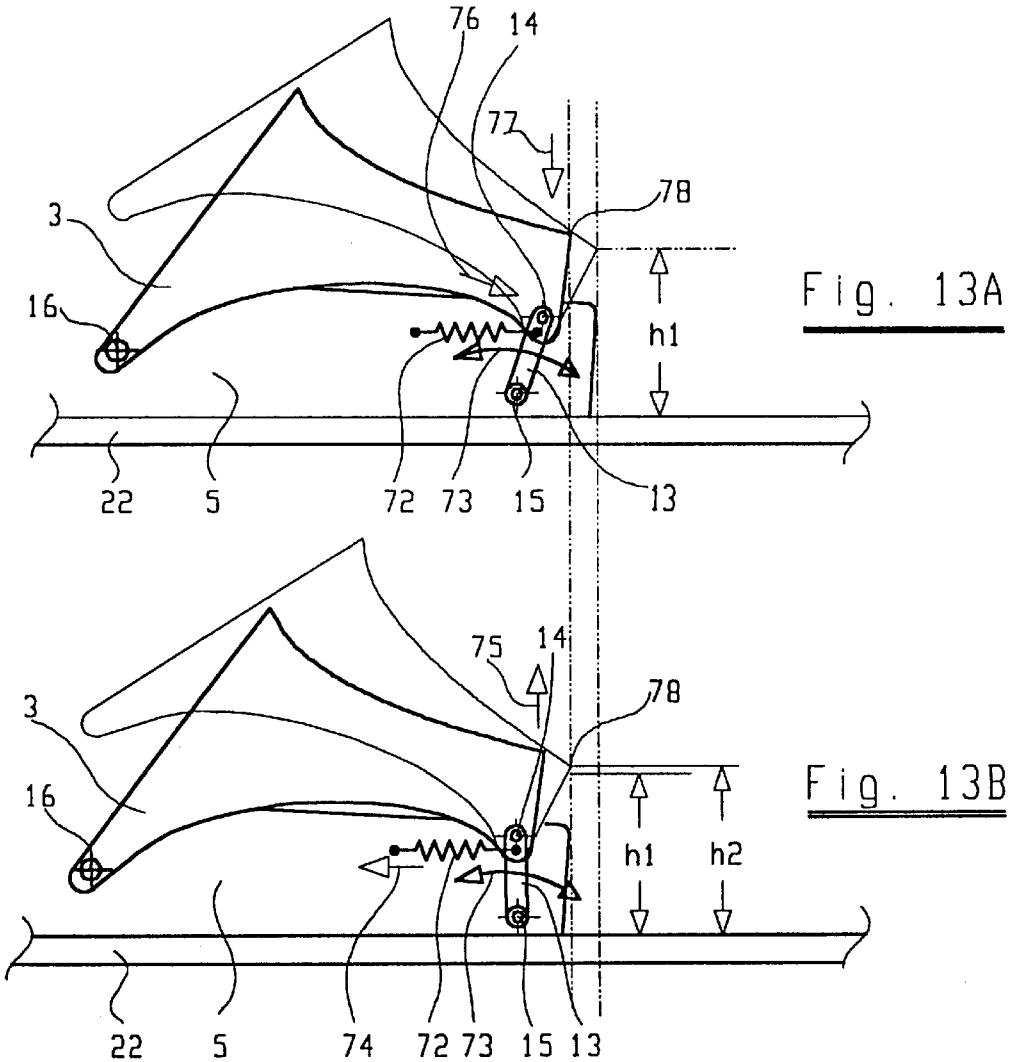
FIGS. 13A and 13B, a side view of the fastening of the instep elements to the lateral cheeks in the open and closed positions.

FIGS. 13A and 13B show the attachment of the instep element 3 to the lateral cheeks 5 by means of the lever 13, which is articulated at one end in a pivot bearing 15 on the lateral cheek 5 and at the other end via an additional pivot bearing 14 to the instep element 3. In the closed position of FIG. 13A, the lever 13, which can be pivoted in both directions of the arrow 73, is in a forward limit position. If one would pivot the tread element upwards about the axis of the pivot joint 14, the front edge 78 would necessarily be moved forwards and downwards and thus clamp the boot in place, so that it can be moved out of the binding only with difficulty, which is indicated by the dashed line of the instep element 3 and the height hi of the front edge 78. Since the lever 13 can pivot, it is pivoted forwards upon insertion of the boot toe, whereby the front end of the instep element 3 is pressed forward in the direction of the arrow 76 and simultaneously somewhat downward in the direction of the arrow 77. Upon opening of the binding (FIG. 13B), on the other hand, the lever 13 is pivoted backwards in the direction of the arrow 74, whereby the pivot bearing 14 and thus also the front edge 78 are moved somewhat upwards in the direction of the arrow 75, which causes the removal of the boot from the binding. The front edge 78 thus assumes the height h2, which is greater than h1, as can be recognized from the drawing on the same scale.

According to a refinement of the invention, the lever 13 is drawn backwards by a spring 72 in the direction of the arrow 74, whereby the removal of the boot is even further eased, since the tread element is then already being brought back by the spring 72 into the open position. The spring 72 is constructed here as a tensile spring that acts in the vicinity of the pivot joint 14 on the lever 13. It is of course also possible to provide a helical spring in the vicinity of the pivot bearing 15, which is supported at one end on the lever 13 and at the other end on the lateral cheek 5.

Figure 14:
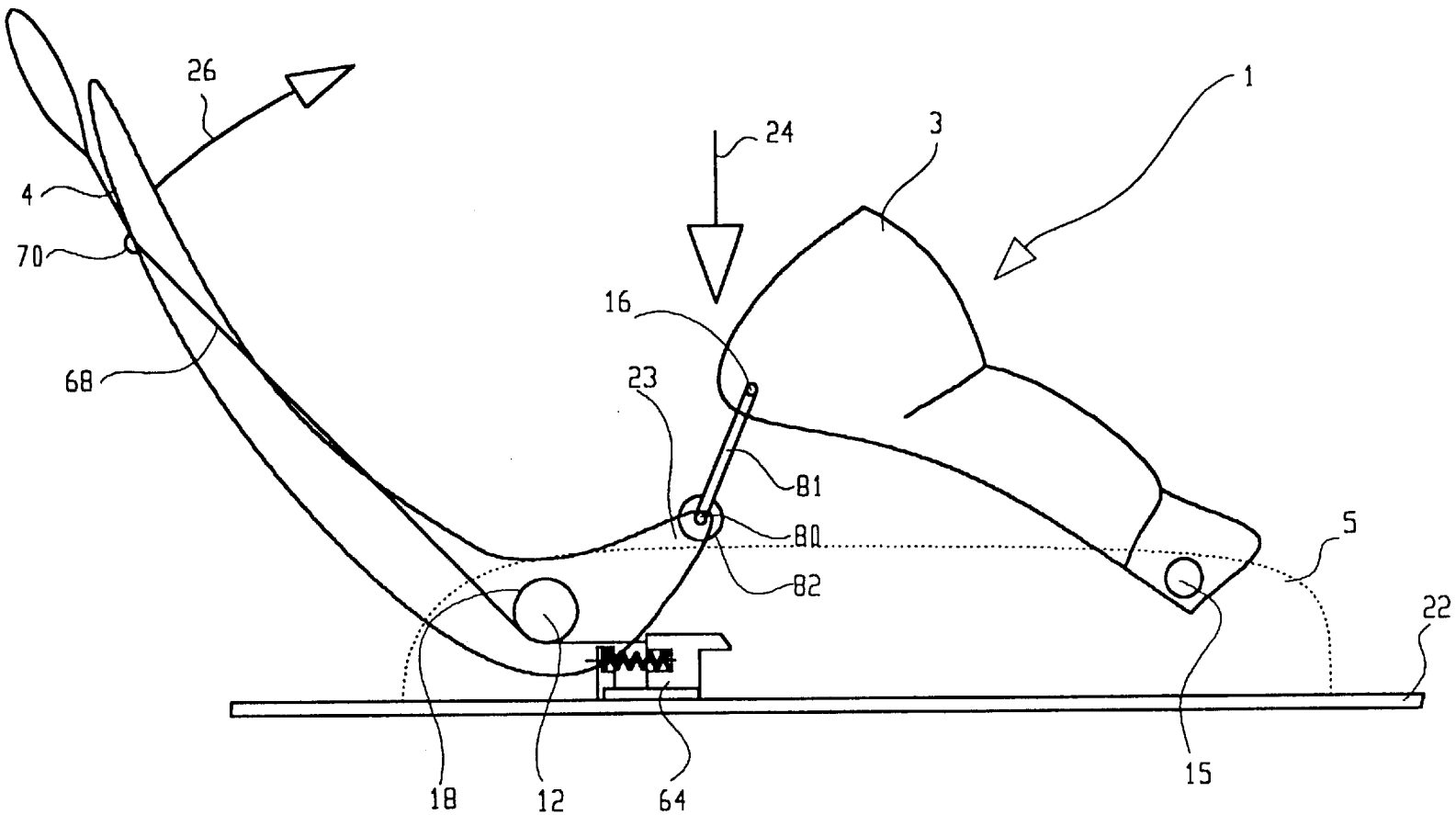
FIG. 14, an additional embodiment of the invention, with a rod running across the longitudinal axis of the binding acting as a tread element.

FIG. 14 shows an additional variant of the invention, in which the tread element is rod 80 running across the longitudinal axis of the boot and connected at both ends to the levers 23 of the heel element 4. Additionally, the back end of the instep element 3 is connected via a tension element 81 to this rod 80 and thus to the lever 23. By pressing the boot down, the rod 80 is moved downwards in the direction of the arrow 24, whereby again the heel element 4 is pivoted about the axis 12 in the direction of the arrow 26 into the closed position; simultaneously, the lever 23 also entrains the back end of the tread element 3 downwards via the tension element 81. The rod 80 is then locked in a locking unit 64, similarly to the embodiment of FIGS. 11 and 12. To ease the stepping down and the locking, a cylinder 82 of a greater diameter is seated on the rod 80 so as to rotate.

Figure 14A:
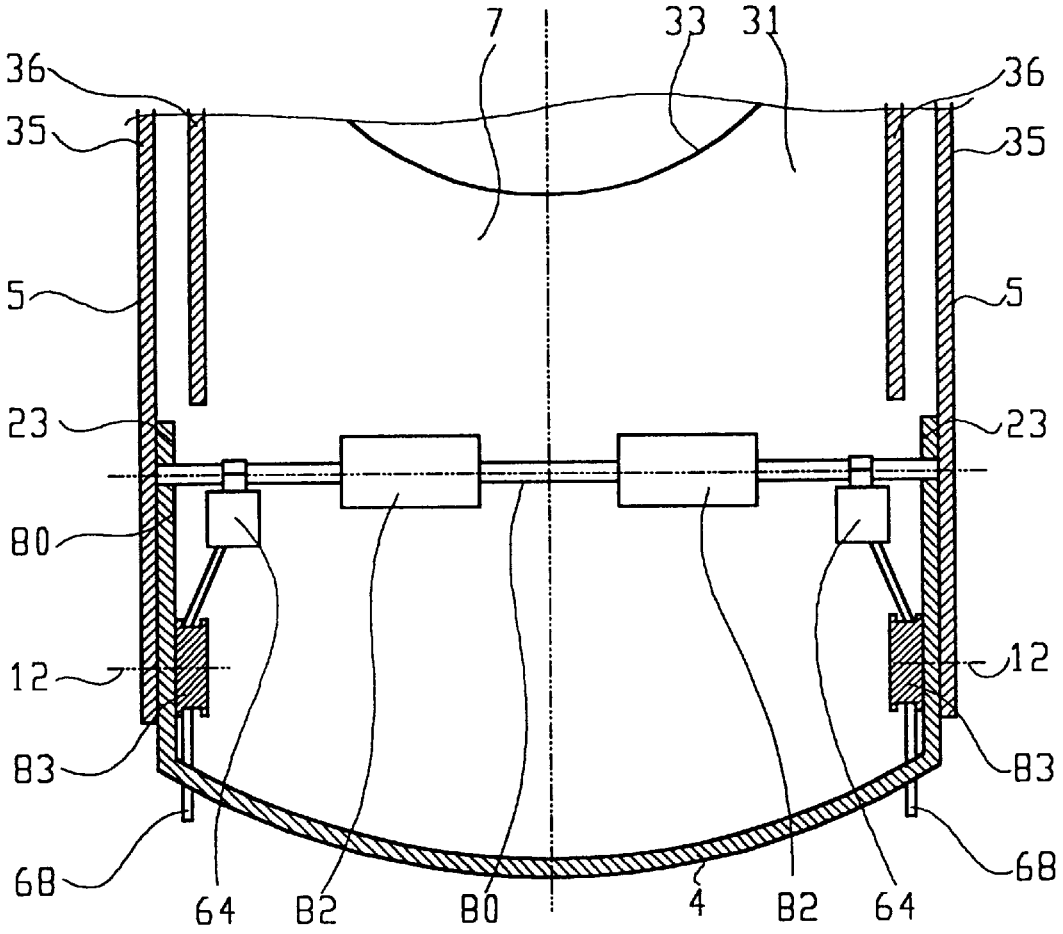
FIG. 14A, a cutoff plane view similar to FIG. 7 or 8 onto the back part of the binding of the embodiment of FIG. 14.

In the plane view of FIG. 14A, it can be seen that the locking units 64 are provided at both sides of the boot. The opening of the binding takes place, in the same manner as in FIGS. 11 and 12, by a tension element 68 that is guided here over an idle roll 83 situated coaxially to the pivot axis 12.

In conclusion, it should be pointed out that the tension element 17 or the tension elements 17 and 17' can be attached either on both sides or on one side of the instep element. In a one-sided use of the tension elements, the element is pivoted essentially about an axis running parallel to the longitudinal axis of the binding. In the arrangement on both sides, there is either a linear displacement in the case of two tension elements on each side, or in the case of one tension element, a pivoting about an axis running parallel to the longitudinal axis of the binding.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Snowboard binding with a base element adapted to be fastened to the surface of a snowboard, an instep element which can be pivoted between an open and closed position, wherein the instep element is movably fastened to the base element and adapted to reach partially over the upper part of a snowboard boot, and a heel element articulated to the base element so as to be adapted to pivot and support the back side of the snowboard boot, which heel element can be pivoted between an open position rearwardly essentially parallel to the snowboard surface and a closed, forward position essentially perpendicular to the snowboard surface, wherein:

the snowboard binding has a movable tread element;

the tread element is coupled to the instep element and the heel element; and the tread, instep and heel elements are designed to work together such that in the case of stepping on the tread element down in the direction towards the snowboard surface, the instep element and the heel element are simultaneously forcibly moved into closed positions to grip the snowboard boot therebetween, and wherein there are means that hold the tread element in the closed position.

2. Snowboard binding according to claim 1, wherein the tread element is formed by a knee lever arrangement that consists of two levers connected so as to pivot via a joint, one of which is attached by means of a pivot bearing to lateral cheeks of the base element, while a free end of the second lever is connected via at least one tension element to an element selected from the group consisting the instep element and the heel element.

3. Snowboard binding according to claim 2, wherein the pivot bearing of the first lever is arranged relative to the free end of the second lever such that the knee lever joint occupies a position past dead center in the closed position.

4. Snowboard binding according to claim 1, wherein the tread element is formed by one single continuous lever, whose one end is fastened in a pivot bearing to the lateral cheeks of the base element and in that this lever is connected in an articulated manner or via at least one tension element to the instep element or the heel element.

5. Snowboard binding according to claim 1, wherein the tread element is formed by a rod running across the longitudinal axis of the binding, in that the heel element is prolonged forward past its pivot joint by means of a lever on either side, in that the rod connects the free ends of these levers, and in that the back end of the instep element is connected directly or via a tension element to the rod.

6. Snowboard binding according to claim 1, wherein the free end of the tread element is connected to a tension element guided along both sides of the binding via idle rolls attached to the lateral cheeks and is fastened in the upper area of the heel element, and in that the idle rolls are arranged in the front area of the binding.

7. Snowboard binding according to claim 1, wherein at least one tension element connected to one side of the back end of the instep element is fastened to the free end of the tread element.

8. Snowboard binding according to claim 7, wherein the tension element is guided over an idle roll mounted on the lateral cheek.

9. Snowboard binding according to claim 6, wherein, at either side of the binding, a tension element connected to the back end of the instep element is provided.

10. Snowboard binding according to claim 1, wherein an additional tension element connected to the free end of the tread element, which is connected to the front end of the instep element, is provided.

11. Snowboard binding according to claim 10 wherein the additional tension element connected to the front end of the instep element is also provided on either side of the binding and is connected via idle rolls to the tread element.

12. Snowboard binding according to claim 1, wherein the front end of the instep element is fastened by means of one lever on each side to the lateral cheeks, with both ends of the lever being connected via a respective pivot bearing to the instep element and the respective lateral cheek.

13. Snowboard binding according to claim 1, wherein the lateral cheeks have a U-shaped cross-sectional profile open towards the snowboard surface and, between parallel walls, form a cavity in which the idle rolls are arranged and part of the tension elements are arranged.

14. Snowboard binding according to claim 1, wherein the levers of the knee lever arrangement are formed with a trapezoidal shape in a plane view and are connected via a shaft surrounded by clips of the levers, with at least one cylinder capable of rotating being arranged on this shaft and projecting radially outward from the shaft.

15. Snowboard binding according to claim 1, wherein the free end of the second lever of the knee lever arrangement is guided in slots of the lateral cheek and in that these slots run essentially parallel to the snowboard surface.

16. Snowboard binding according to claim 1 in combination with a snowboard boot, wherein the snowboard boot has a recess into which the tread element engages positively in the open position and during the closing process.

17. Snowboard binding according to claim 1, wherein at least one spring element, preferably a resilient lock washer, is provided, which holds in place an element of the tread element running across the longitudinal axis of the snowboard in the closed position.

18. Snowboard binding according to claim 1, wherein an opening lever running essentially parallel to the back side of the heel element is rigidly fastened to the second lever of the knee lever arrangement.

19. Snowboard binding according to claim 1, wherein a tension element guided up to the upper area of the heel element and fastened there is arranged on the joint of the knee lever arrangement.

20. Snowboard binding according to claim 1, wherein a locking unit is provided, which is prestressed into a closed position by a spring and which reaches with a tab in a form fit over an element of the tread element and holds it in place in the closed position.

21. Snowboard binding according to claim 4, wherein the continuous lever has a slot in its longitudinal direction, in which a pin coupling the heel element and the instep element is guided in a movable manner.

22. Snowboard binding according to claim 11, wherein the lever connecting the front end of the instep element to the respective lateral cheek is prestressed by a spring into an opening position of the binding in which the lever is pivoted backwards in the direction of the heel element.

23. Snowboard binding according to claim 5, wherein the lever of the heel element is connected at either side of the binding by means of a respective tension element to the back end of the instep element.

24. Snowboard binding according to claim 1, wherein the tension elements are steel cables.

25. Snowboard binding with a base element or chassis adapted to be fastened to the surface of a snowboard, an instep element movably mounted to the base element or chassis, the instep element adapted to partially reach over the upper side of a snowboard boot, and a heel element articulated in a pivoting manner in relation to the base element and adapted to support the back side of the snowboard boot, wherein the snowboard binding has a movable tread element that is coupled to the instep element and with means being provided that hold the tread element in the closed position, wherein:

the heel element is pivotable between an open position essentially parallel to the snowboard surface and an essentially vertical closed position;

the tread element is fastened to the base element or chassis by a pivot bearing and is coupled by at least one first tension element to the instep element and additionally by at least one second tension element to the heel element;

the free end of the tread element is connected to a respective first end of the first and second tension elements;

both tension elements are guided via idle rolls mounted on a lateral cheek; and the other end of the first tension element is connected to one side of the back end of the instep element and the other end of the second tension element is fastened in the upper area of the heel element, whereby the coupling is designed such that in the case of pressing the tread element down in the direction of the snowboard surface, the instep element and the heel element are simultaneously forcibly moved into their closed position.

* * * * *